US008097391B2

(12) United States Patent
Iga

(10) Patent No.: US 8,097,391 B2
(45) Date of Patent: Jan. 17, 2012

(54) TONER FOR DEVELOPING ELECTROSTATIC IMAGE

(75) Inventor: Takashi Iga, Tokyo (JP)

(73) Assignee: Zeon Corporation, Tokyo (JP)

( * ) Notice: Subject to any disclaimer, the term of this patent is extended or adjusted under 35 U.S.C. 154(b) by 618 days.

(21) Appl. No.: 12/162,642

(22) PCT Filed: Jan. 29, 2007

(86) PCT No.: PCT/JP2007/051403

§ 371 (c)(1),
(2), (4) Date: Jul. 30, 2008

(87) PCT Pub. No.: WO2007/088814

PCT Pub. Date: Aug. 9, 2007

(65) Prior Publication Data

US 2009/0047590 A1 Feb. 19, 2009

(30) Foreign Application Priority Data

Jan. 31, 2006 (JP) ..... 2006-023321
Mar. 31, 2006 (JP) ..... 2006-097466
Mar. 31, 2006 (JP) ..... 2006-097472
Mar. 31, 2006 (JP) ..... 2006-097497

(51) Int. Cl.
*G03G 9/08* (2006.01)

(52) U.S. Cl. ..... 430/108.8; 430/108.1; 430/110.2

(58) Field of Classification Search ..... 430/108.1, 430/108.8, 110.2

See application file for complete search history.

(56) References Cited

U.S. PATENT DOCUMENTS

| | | | | |
|---|---|---|---|---|
| 2005/0026061 | A1* | 2/2005 | Mikuriya et al. | 430/108.1 |
| 2005/0095523 | A1 | 5/2005 | Shimokusa et al. | |
| 2005/0208411 | A1* | 9/2005 | Nakayama et al. | 430/109.4 |

FOREIGN PATENT DOCUMENTS

| | | | | |
|---|---|---|---|---|
| JP | 3-11363 | A | | 1/1991 |
| JP | 03-091764 | A | | 4/1991 |
| JP | 2003-005431 | A | | 1/1992 |
| JP | 09-106113 | A | | 4/1997 |
| JP | 10-282713 | A | | 10/1998 |
| JP | 2000-035690 | A | | 2/2000 |
| JP | 2000-352838 | A | | 12/2000 |
| JP | 2002-091055 | A | | 3/2002 |
| JP | 2002-212142 | A | | 7/2002 |
| JP | 2003-140379 | A | | 5/2003 |
| JP | 2004-163771 | A | | 6/2004 |
| JP | 2004-251932 | A | | 9/2004 |
| JP | 2004-347918 | | * | 12/2004 |
| JP | 2004-347918 | A | | 12/2004 |
| JP | 2005-141189 | A | | 6/2005 |
| JP | 2005-221571 | A | | 8/2005 |
| JP | 2005-266753 | | * | 9/2005 |
| JP | 2005-266753 | A | | 9/2005 |
| JP | 2005-331953 | A | | 12/2005 |

OTHER PUBLICATIONS

Translation of JP 2004-347918 published Dec. 2004.*
Translation of JP 2005-266753 published Sep. 2005.*
International Search Report of PCT/JP2007/051403, date of mailing May 22, 2007.
Japanese Office Action dated Mar. 29, 2011, issued in corresponding Japanese Patent Application No. 2006-023321.

* cited by examiner

*Primary Examiner* — Peter Vajda
(74) *Attorney, Agent, or Firm* — Westerman, Hattori, Daniels & Adrian, LLP

(57) ABSTRACT

Provided is a toner for developing electrostatic image which is excellent in shelf stability, and is further excellent in low-temperature fixability so as to be capable of maintaining a high fixing rate even at a low fixing temperature.

A toner for developing electrostatic image is used which comprises colored resin particles containing a binder resin, a colorant, and a parting agent, wherein the parting agent is an aliphatic hydrocarbon polymer obtained by polymerizing an aliphatic hydrocarbon monomer.

12 Claims, No Drawings

TONER FOR DEVELOPING ELECTROSTATIC IMAGE

TECHNICAL FIELD

The present invention relates to a toner, for developing electrostatic image, which can be used in development in machines using electrophotography, such as a coping machine, a facsimile machine and a printer.

BACKGROUND ART

In image-forming devices using electrophotography, such as a coping machine, a facsimile machine and a printer, an image is formed by at first developing an electrostatic latent image formed on a photosensitive member with a toner for developing electrostatic image, which may be referred to merely as a toner hereinafter, next transferring the formed toner image on a recording material such as a paper piece, and then fixing the image in various manners such as heating, pressing and solvent evaporation.

In recent years, for these image-forming devices, energy consumption has been required to be decreased and printing has been required to be made highly speedy. Out of steps of forming an image according to electrophotography, the step of consuming a particularly large quantity of energy is a step of fixing a toner on a recording material (fixing step). The manner used in the fixing is generally a manner of attaining the fixing by heating and pressing, using a fixing roller. In this manner, usually it is necessary to make the temperature of the fixing roller high in the fixing. From the viewpoint of energy conservation, this temperature of the fixing roller in the fixing is required to be made low. Furthermore when the fixing can be attained at a low temperature, the fixing can cope with printing at a high speed; therefore, the temperature of the fixing roller in the fixing is required to be made low also from the viewpoint of the requirement of making the printing speed high.

About toner, a toner wherein the minimum fixing temperature thereof is low is desired. In order to yield a toner excellent in low-temperature fixability, the following methods have been hitherto suggested: a method of lowering the glass transition temperature of a toner; a method of adding a resin having a low melting point or a low molecular weight, or the like; a method of incorporating, into a toner, a low-softening point substance having a releasing characteristic, such as wax; and other methods.

In the meantime, the shelf stability of toner is required as a characteristic conflicting with the low-temperature fixability. The shelf stability is a characteristic showing the degree of a matter that when a toner is stored at high temperature, aggregation (blocking) of the toner is not easily caused. This characteristic is a characteristic necessary for causing a toner not to aggregate when the toner is transported or when the temperature of the inside of a printer is raised by heat-fixing generated in printing.

In order to attain the above-mentioned required themes, suggested are techniques about resin or wax to be added to toner.

Patent Document 1 suggests a toner containing a 1-olefin polymer wax that is made of units each derived from a 1-olefin represented by $R'CH{=}CH_2$ wherein R': an alkyl having 1 to 28 carbon atoms, and that has a DSC melting point of 70 to 130° C., a molecular weight M of 100 to 25,000 and a molecular weight distribution Mw/Mn of 1.5 to 3.0 (claim 1), and discloses a toner containing a polypropylene wax having a DSC melting point of 81 to 120° C.

Patent Document 2 suggests a solid toner for wet development wherein toner particles comprising a colorant, a binder resin and so on (colored resin particles) are dispersed in an electrically insulating medium containing: a polymer wax obtained by polymerizing an α-olefin having 19 to 60 carbon atoms; and a crystalline wax.

However, it has been demonstrated by the investigations of the present inventor that when the toner using the wax described in Patent Document 1 is used in recent color printers, the low-temperature fixability is not yet sufficient against the requirement that the low-temperature fixability should be made better while the existing shelf stability is kept.

The polymer wax described in Patent Document 2, which is obtained by polymerizing the α-olefin, is a wax used as a medium for a solid toner for wet development (that is, a matrix in the toner). When the wax is used as a component contained in colored resin particles, there arises a problem that the shelf stability of the toner lowers.

Moreover, the printing durability of toner is also required as a characteristic conflicting with the low-temperature fixability. The printing durability is a characteristic that even when printing is made on a large number of sheets, printing qualities such as image quality can be maintained. In a toner cartridge, a toner is required to be less deteriorated by stress which the toner undergoes from printing on a large number of sheets, and by other factors. The printing durability is required particularly not to generate fog when continuous printing is made.

Furthermore, as the formation of color images has been spreading in recent years, the quality required for color toner used in the formation has been becoming higher. Thus, the characteristics conflicting with the low-temperature fixability have also been requested to be further improved. There has been particularly desired a toner good in printing durability even after the toner is put in a high temperature environment when transported, or when the toner is used in printing in a high temperature environment.

In order to solve the above-mentioned problems while the requirement about the low-temperature fixability is satisfied, various suggestions are made.

In order to yield toner excellent in both of low-temperature fixability and printing durability, Patent Document 3 discloses a toner, for developing electrostatic image, containing, as a parting agent, a paraffin wax having a melting point of 60 to 85° C. and a penetration of 4 to 10 at 25° C. However, when the parting agent described in Patent Document 3 is used, the printing durability deteriorates largely after the toner is stored at high temperature.

In order to yield toner excellent in both of low-temperature fixability and shelf stability, Patent Document 4 discloses a toner, for developing electrostatic image, containing 1 to 15 parts by weight of a wax about which an endothermic range based on DSC is present only in a temperature range of 50° C. or higher for 100 parts by weight of a binder resin. As the wax, a wax is used which is obtained by removing, from esters made from aliphatic acid and alcohol, fractions having a DSC endothermic range of 50° C. or lower, and purifying the resultant. However, when the wax described in Patent Document 4 is used, the printing durability deteriorates as well when the toner is stored at high temperature.

Patent Document 5 suggests a toner which contains an ester component having a penetration of 4 or less as a main essential component, and a wax having a melting point of 60 to 110° C., and which is produced by an emulsion polymerization coagulation method. However, the toner in Patent Document 5 is insufficient for compatibility at a high level between low-temperature fixability and shelf stability, and a level required about printing durability, which are associated with recent spread in color printers.

In order to yield toner excellent in all of low-temperature fixability, shelf stability, and printing durability, in particular printing durability when the toner is stored at high temperature, Patent Document 6 discloses a toner, for developing electrostatic image, comprising colored resin particles containing a binder resin, a colorant and a specific ester compound. The ester compound described in Patent Document 6 is characterized in that when the endothermic peak in the DSC curve thereof is 65° C. or higher, the endothermic value at a temperature 20° C. lower than the endothermic peak temperature is represented by A (mW), the endothermic value at a temperature 50° C. lower than the endothermic peak temperature is represented by B (mW), the number of ester bonds therein is represented by C and the amount of the ester compound used as the sample to be measured is represented by D (mg), a relationship represented by the following expression is satisfied:

relational expression: $0 \leqq |A-B|/(C \times D) \leqq 0.02$

However, even when the ester compound described in Patent Document 6 is used, the printing durability after the toner is stored at high temperature becomes lower than that before the high-temperature storage.

A characteristic of toner required besides low-temperature fixability, shelf stability and printing durability is offset resistance. The offset resistance is a characteristic showing the latitude of a temperature range in which the toner can be fixed. In particular, about toner which can be fixed at low temperature, it is necessary that stable printing quality is obtained even when the temperature of a fixing roller is broad. Thus, the toner is required not to be adhered to the fixing roller even at a high fixing temperature.

Patent Document 7 discloses a toner containing an ester wax (corresponding to a "low molecular weight wax") and a hydrocarbon wax (corresponding to an "aliphatic hydrocarbon polymer") which each have a melting point in the range from 55 to 120° C., wherein the melting point of the ester wax is lower (claim 1). It is stated that the weight-average molecular weight (Mw) of the ester wax ranges from 350 to 1,500 and the weight-average molecular weight (Mw) of the hydrocarbon wax ranges from 300 to 4,000 (claims 3 and 4).

Patent Document 8 discloses a toner for developing electrostatic image containing a polyester as a binder resin, and an ester wax (corresponding to a "low molecular weight wax") and a petroleum wax (corresponding to a portion of a paraffin wax "aliphatic hydrocarbon polymer") as a parting agent (claims 1 and 2). Furthermore, it is stated that the melting point of the petroleum wax is preferably 70° C. or higher. The molecular weight of the ester wax and that of the petroleum wax are not described.

Patent Document 9 discloses a toner for electrophotography containing: a wax-containing resin obtained by polymerizing a monomer in the presence of a high melting point wax (polyethylene wax (corresponding to an "aliphatic hydrocarbon polymer")) having a melting point of 75 to 140° C.; and a low melting point wax (ester wax (corresponding to a "low molecular weight wax") having a melting point of 50 to 90° C. (claims 1 to 3). The molecular weight of the ester wax and that of the polyethylene wax are not described.

However, the toners of Patent Document 7 to 9 are insufficient for satisfying a recent high level requirement that a balance between low-temperature fixability and shelf stability is kept at a high level while toner should have offset resistance and printing durability.

Patent Document 1: Japanese Patent Application laid-Open (JP-A) No. 2000-352838
Patent Document 2: JP-A No. Hei. 9-106113
Patent Document 3: JP-A No. 2005-266753
Patent Document 4: JP-A No. Hei. 3-91764
Patent Document 5: JP-A No. 2000-35690
Patent Document 6: JP-A No. 2005-221571
Patent Document 7: JP-A No. 2004-251932
Patent Document 8: JP-A No. 2005-141189
Patent Document 9; JP-A No. 2003-5431

DISCLOSURE OF INVENTION

Problems to be Solved by the Invention

In light of the above-mentioned actual situation, the present invention has been made, and a first object thereof is to provide a toner for developing electrostatic image which has excellent shelf stability, and further has excellent low-temperature fixability, which makes it possible that a high fixing rate is kept even at a low fixing temperature.

A second object of the invention is to provide a toner for developing electrostatic image which has excellent shelf stability and printing durability, in particular excellent printing durability after the toner is stored at high temperature without damaging the low-temperature fixability.

Furthermore, a third object of the invention is to provide a toner for developing electrostatic image wherein a balance between shelf stability and low-temperature fixability is well kept and excellent offset resistance and printing durability are exhibited.

Means for Solving the Problems

The inventor has repeatedly made eager investigations so as to find out that the above-mentioned problems can be solved by a toner for developing electrostatic image comprising colored resin particles which contains a specific aliphatic hydrocarbon polymer.

Thus, according to the present invention, there can be provided a toner for developing electrostatic image comprising colored resin particles containing a binder resin, a colorant and a parting agent, wherein the parting agent is an aliphatic hydrocarbon polymer obtained by polymerizing an aliphatic hydrocarbon monomer.

The melting point (TmD) of the aliphatic hydrocarbon polymer is desirably lower than 80° C.

Specifically, a toner for developing electrostatic image according to a first invention is a toner wherein the parting agent is characterized by the following:

(1) the agent has a single melting point (TmD) defined as the temperature of the top of a peak in the DSC curve of the agent according to a Differential Scanning Calorimetry (DSC), (2) the halt value width of the peak is 12° C. or less, and (3) the agent is an aliphatic hydrocarbon polymer.

A toner for developing electrostatic image according to a second invention is a toner wherein the parting agent is characterized by the following:

(1) the penetration (JIS K2235-1991) at 25° C. of the agent is 3 or less, (2) the solubility thereof in toluene at 25° C. is in the range from 5 to 60% by weight, and (3) the agent is an aliphatic hydrocarbon polymer.

In this case, the melting point (TmD) of the aliphatic hydrocarbon polymer is desirably 40° C. or higher and lower than 80° C.

Furthermore, a toner for developing electrostatic image according to a third invention is a toner wherein the parting agent is characterized by the following:

(1) the melting point (TmD) of the agent is 70° C. or lower, (2) the penetration (JIS K2235-1991) at 25° C. of the agent is 3 or less, (3) the agent is an aliphatic hydrocarbon polymer.

In this case, the weight-average molecular weight of the aliphatic hydrocarbon polymer is preferably 10,000 or more and 100,000 or less.

The aliphatic hydrocarbon polymer is preferably a higher α-olefin polymer obtained by polymerizing an α-olefin monomer having 10 or more carbon atoms. The higher α-olefin polymer may be a polymer obtained by polymerization in the presence of a metallocene compound as a catalyst. The α-olefin monomer more preferably has 16 or more carbon atoms.

A different parting agent may be used together with the aliphatic hydrocarbon polymer.

Furthermore, a toner for developing electrostatic image according to a fourth invention is a toner wherein the parting agent is characterized by the following:

(1) the agent is an aliphatic hydrocarbon polymer having a peak top molecular weight of 10,000 or more and a melting point of 70° C. or lower; and (2) the agent is a low molecular weight wax having a peak top molecular weight of 5,000 or less.

The low molecular weight wax is preferably an ester wax.

In this case, it is preferred that the melting point (TmD) of the aliphatic hydrocarbon polymer is equal to or lower than the melting point (TmD) of the low molecular weight wax. It is also preferred that the ratio by content of the aliphatic hydrocarbon polymer to the low molecular weight wax (the content of the aliphatic hydrocarbon polymer/the content of the low molecular weight wax) is in the range from 98/2 to 25/75.

According to the invention, the colored resin particles may be produced by a wet method. Moreover, it is preferred that the colored resin particles are core-shell structured colored resin particles.

Effect of the Invention

According to the invention, provided is a toner for developing electrostatic image that has excellent shelf stability, and further has excellent low-temperature fixability, which makes it possible that a high fixing rate is kept even at a low fixing temperature.

According to the invention, provided is also a toner for developing electrostatic image which has excellent shelf stability and printing durability, in particular excellent printing durability after the toner is stored at high temperature without damaging the low-temperature fixability.

According to the invention, provided is also a toner for developing electrostatic image wherein a balance between shelf stability and low-temperature fixability is well kept and excellent offset resistance and printing durability are exhibited.

BEST MODE FOR CARRYING OUT THE INVENTION

A toner for developing electrostatic image of the invention, and a producing process thereof will be described hereinafter.

The toner for developing electrostatic image of the invention (in the invention, the "toner for developing electrostatic image" may be referred to merely as the "toner") contains colored resin particles. The colored resin particles contain a binder resin and a colorant, and further contain, as a parting agent, an aliphatic hydrocarbon polymer obtained by polymerizing an aliphatic hydrocarbon monomer. Furthermore, the colored resin particles may optionally contain other additives such as a charge control agent.

Specific examples of the binder resin include vinyl resins such as polystyrene and styrene-butyl acrylate copolymer, polyester resins, epoxy resins, and cyclized isoprene rubbers that have been hither to used widely in toner. The number-average molecular weight of the binder resin is not particularly limited, and is usually in the range from 2,000 to 50,000, preferably in the range from 3,000 to 30,000.

The colorant may be various pigments and dyes used in the field of a toner. When a color toner is produced, colorants in cyan, yellow and magenta may be used besides colorants in black and white.

The colorant in black may be a dye or pigment such as carbon black, titanium black or nigrosin base; a pigment of a magnetic powder or the like such as cobalt, nickel, magnetite, ferrosoferric oxide, iron manganese oxide, iron zinc oxide, or iron nickel oxide; or the like. The carbon black is preferably carbon black having a primary particle diameter in the range from 20 to 40 nm. When the diameter is in this range, the carbon black can be dispersed evenly into the toner and fog is less generated.

The colorant in white may be titanium white or the like.

The colorant in cyan may be a copper phthalocyanine compound, a derivative thereof, an anthraquinone compound or the like. Examples thereof include C.I. Pigment Blues 2, 3, 15, 15:1, 15:2, 15:3, 15:4, 16, 17:1, and 60.

The colorant in yellow may be a compound including an azo pigment such as a monoazo pigment or a disazo pigment, and a condensed polycyclic pigment. Examples thereof include C.I. Pigment Yellows 3, 12, 13, 14, 15, 17, 62, 65, 73, 74, 83, 93, 97, 120, 138, 155, 180, 181, 185, 186 and 213.

The colorant in magenta may be a compound including an azo pigment such as a monoazo pigment or a disazo pigment, and a condensed polycyclic pigment. Examples thereof include C.I. Pigment Reds 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C.I. Pigment Violet 19.

The amount of each of the colorants is usually in the range from 1 to 50 parts by weight for 100 parts by weight of the binder resin, and is preferably in the range from 1 to 20 parts by weight therefor.

In the invention, the above-mentioned specific aliphatic hydrocarbon polymer is used as the parting agent in order to yield a toner having both of shelf stability at a high level, and low minimum fixing temperature, that is, low-temperature fixability at a high level.

The aliphatic hydrocarbon polymer used in the invention is a polymer obtained by polymerizing an aliphatic hydrocarbon monomer, which is a hydrocarbon containing no aromatic ring, out of hydrocarbons made only of carbon atoms and hydrogen atoms.

The aliphatic hydrocarbon polymer preferably has a melting point (TmD) lower than 80° C. If the melting point is over this range, the resultant toner is poor in shelf stability so that the toner adheres easily. The melting point is measured with a Differential Scanning Calorimetry (DSC). The measurement of the aliphatic hydrocarbon polymer with a Differential Scanning Calorimetry (DSC) is made in accordance with ASTM D3418-82, and a commercially available Differential Scanning Calorimetry may be used. The commercially available Differential Scanning Calorimetry may be, for example, a differential scanning calorie analyzer (trade name: RDC-220, manufactured by Seiko Instruments Ltd.). The measurement is made under the condition that the temperature rises at 10° C./minute in the range from −20 to 100° C.

(First Invention)

When such a parting agent is an aliphatic hydrocarbon polymer (3) having characteristics (1) and (2) described below, a toner excellent in shelf stability and low-temperature fixability can be obtained.

(1) The agent has a single melting point (TmD) defined as the temperature of the top of a peak in the DSC curve of the agent according to a Differential Scanning Calorimetry (DSC).

(2) The half value width of the peak is 12° C. or less.

(3) The agent is an aliphatic hydrocarbon polymer having the characteristics (1) and (2).

The aliphatic hydrocarbon polymer used in the invention has a single melting point (TmD) defined as the temperature of the top of a peak in the DSC curve of the agent according to a Differential Scanning Calorimetry (DSC), the half value width of the peak being 12° C. or lower. The half value width of the peak is preferably 10° C. or lower, more preferably 8° C. or lower. If the half value width is over this range, the resultant toner is poor in shelf stability so that the toner adheres easily. The melting point (TmD) is preferably 40° C. or more and lower than 80° C., more preferably 45° C. or more and lower than 70° C., even more preferably 50° C. or more and lower than 65° C. The higher α-olefin polymer in the invention has a single peak in the DSC curve thereof, as described above. This single peak may have a shoulder, and preferably has no shoulder.

Specific examples of the material that may be used as the aliphatic hydrocarbon polymer include paraffin wax, microcrystalline wax, Fisher-Tropsch wax, and α-olefin polymers, and other waxes. In particular, many higher α-olefin polymers have the above-mentioned characteristics.

A higher α-olefin polymer obtained by polymerizing an α-olefin monomer having 10 or more carbon atoms is particularly preferred, and the number of the carbon atoms is more preferably 16 or more, even more preferably 18 or more and 24 or less, in particular preferably 22 or more and 24 or less. When the number of the carbon atoms is in the range, the specific higher α-olefin polymer in the invention is easily obtained. If the number of the carbon atoms is over the range, the resultant toner may be poor in low-temperature fixability. If the number of the carbon atoms is below the range, a problem may be caused about the shelf stability. The α-olefin monomer is preferably a monomer purified by distillation or some other method.

Specific examples of such a preferred α-olefin monomer include 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tricosene, 1-tetracosene, 1-pentacosene, and 1-hexacosene. Preferred are 1-eicosene, 1-docosene, 1-tetracosene, and 1-hexacosene.

About the higher α-olefin polymer in the invention, the weight-average molecular weight Mw is preferably in the range from 15,000 to 110,000, more preferably in the range from 20,000 to 100,000. The molecular weight distribution Mw/Mn, which is represented by the ratio of the Mw to the number-average molecular weight Mn, is preferably in the range from 1.5 to 3.0, more preferably in the range from 1.6 to 2.8.

In the invention, the weight-average molecular weight Mw, the number-average molecular weight Mn, and the peak top molecular weight Mp are each a polystyrene-converted molecular weight measured by gel permeation chromatography (GPC). Specifically, the molecular weights may be measured as follows:

As a measuring device, a GPC measuring device (trade name: Alliance GPC 2000, manufactured by Waters Co.) is used. About a sample solution to be injected, a solution of a polymer in 1,2,4-trichlorobenzene (containing 300 ppm of dibutylhydroxytoluene) having a concentration of 1 mg/mL or a solution of a wax in the same solvent having a concentration of 0.5 mg/mL is filtrated through a 0.5-μm membrane filter, and then 240 μL of the resultant filtrate is used. About a column, a mixed polystyrene gel column (trade name: GMHHR-H(S)HT, manufactured by Tosoh Corp.) is used. The molecular weights are each obtained by measurement under the condition that the column temperature is 145° C. and the flow rate is 1.0 mL/min. For detection, an infrared ray detector is used, and a wavelength of 3.41 μm is used.

In order to obtain the higher α-olefin polymer, an α-olefin monomer is polymerized preferably in the presence of a metallocene compound as a catalyst.

Examples of the metallocene compound include zirconium compounds, such as zirconium dichloride compounds such as dimethylsilylenebis(2-methyl-4,5-benzoindenyl)zirconium dichloride, dimethylsilylenebis(2-methyl-4-phenylindenyl)zirconium dichloride, dimethylsilylenebis(2-methyl-4-naphthylindenyl)zirconium dichloride, dimethylsilylenebis(2-methylindenyl)zirconium dichloride, ethylenebis (2-methylindenyl)zirconium dichloride, (1,2'-dimethylsilylene)(2,1'-dimethylsilylene)bis(3-trimethylsilylmethyl-indenyl)zirconium dichloride, (1,2'-dimethylsilylene)(2,1'-dimethylsilylene)(3-trimethylsilylmethyl-indenyl)(indenyl)zirconium dichloride, (1,2'-dimethylsilylene)(2,1'-dimethylsilylene)bis(indenyl) zirconium dichloride, (1,2'-dimethylsilylene)(2,1'-dimethylsilylene)bis(3-n-butylindenyl)zirconium dichloride, (1,2'-dimethylsilylene)(2,1'-dimethylsilylene)(n-butyl-indenyl)(indenyl)zirconium dichloride, (1,2'-dimethylsilylene)(2,1'-dimethylsilylene)bis(indenyl) zirconium dichloride, 1,1'-dimethylsilylenebis(2-ethyl-4-(2-fluoro-4-biphenylyl)-4H-azulenyl)zirconium dichloride and dimethylsilylene(cyclopentadienyl)(2,4-dimethyl-4H-1-azulenyl)zirconium dichloride, and compounds obtained by substituting dichloride in these zirconium dichloride compounds with dimethyl or dibenzyl; and titanium compounds obtained by substituting zirconium in these zirconium compounds with titanium.

The above-mentioned metallocene compounds may be used alone or in combination of two or more thereof. Furthermore, in order to obtain an α-olefin polymer having the above-mentioned characteristics, it is preferred to use, besides the metallocene compounds, an organic aluminum compound such as triisobutylaluminum, or an organic boron compound such as dimethylanilinium tetrakispentafluorophenylborate as the catalyst.

The amount of the aliphatic hydrocarbon polymer is preferably in the range from 1 to 50 parts by weight for 100 parts by weight of the binder resin. If the amount of the aliphatic hydrocarbon polymer is smaller than the range, the effect of improving the low-temperature fixability is low. If this amount is larger than the range, the printing durability deteriorates.

In the invention, together with the aliphatic hydrocarbon polymer, a different parting agent may be used. Examples of the parting agent used together include end-modified polyolefin waxes such as molecular-end-oxidized low molecular weight polypropylene, low molecular weight end-modified polypropylene having molecular ends substituted with epoxy groups, and block polymers of these polypropylene and low molecular weight polyethylene, molecular-end-oxidized low molecular weight polyethylene, low molecular weight polyethylene having molecular ends substituted with epoxy groups, and block polymers of these polyethylene and low molecular weight polypropylene; natural waxes such as candelilla, carnauba, rice wax, haze wax, and jojoba; pentaerythritol esters such as pentaerythritol tetramyristate, pentaerythritol tetrapalmitate, and pentaerythritol tetralaurate; dipentaerythritol esters such as dipentaerythritol hexamyristate, dipentaerythritol hexapalmitate, and dipentaerythritol hexylaurate; hexaglycerol esters such as hexaglycerol octabehenate; and decaglycerol esters such as decaglycerol dodecabehenate. The above-mentioned examples of the parting agent may be used alone or in combination of two or more thereof.

In the invention, the method of producing a colored resin particles may be a dry method such as a pulverization method, or a wet method such as an emulsion polymerization coagulation method, a dispersion polymerization method, a suspension polymerization method, or a solution suspension method. A wet method is preferred since a toner excellent in printing properties such as image reproducibility is easily obtained. In particular, polymerization methods such as an emulsion polymerization coagulation, a dispersion polymerization, a suspension polymerization and other methods are more preferred and a suspension polymerization method is even more preferred since the resultant particles have a relatively small particle size distribution in a micro-order.

In the emulsion polymerization coagulation method as a wet method, an emulsified polymerizable monomer is polymerized to yield resin fine particles, and the particles are coagulated with a colorant and so on to produce colored resin particles. The solution suspension method is a method of forming a solution wherein toner components such as a binder resin and a colorant are dissolved or dispersed in an organic solvent into droplets in an aqueous medium, and then removing the organic solvent to produce colored resin particles. In each of the methods, a known manner may be used.

In the case of adopting a suspension polymerization method, which is a method more preferable for producing the toner of the invention, to produce colored resin particles, the production is performed by a process as described below. First, a polymerizable monomer, a colorant, an aliphatic hydrocarbon polymer as a parting agent, and optionally other additives such as a charge control agent are mixed with each other to prepare a polymerizable monomer composition. This polymerizable monomer composition is put into an aqueous medium containing a dispersion stabilizer, and then formed into droplets. Thereafter, in the presence of a polymerization initiator, polymerization is performed to yield an aqueous dispersion liquid of colored resin particles. This aqueous dispersion liquid is washed, dehydrated and dried. The colored resin particles dried was yielded. The dried colored resin particles are optionally classified, and are mixed with external additives. A carrier is optionally added to the resultant particles, so as to yield the toner.

The polymerizable monomer is a main component which will be a binder resin, and is a polyrerizable compound. In the above-mentioned colorant and other components, the weight of the binder resin, which is the basis of the amounts of the components, is substantially equal to the weight of the polymerizable monomer, and may be substituted with the weight of the polymerizable monomer.

As a main species of the polymerizable monomer, a monovinyl monomer is preferably used. Examples of the monovinyl monomer include styrene; styrene derivatives such as vinyltoluene and α-methylstyrene; acrylic acid and methacrylic acid; acrylic acid esters such as methyl acrylate, ethyl acrylate, propyl acrylate, butyl acrylate, 2-ethylhexyl acrylate, and dimethylaminoethyl acrylate; methacrylic acid esters such as methyl methacrylate, ethyl methacrylate, propyl methacrylate, butyl methacrylate, 2-ethylhexyl methacrylate, and dimethylaminoethyl methacrylate; amide compounds such as acrylamide and methacrylamide; olefins such as ethylene, propylene, and butylene; vinyl halides and vinylidene halides such as vinyl chloride, vinylidene chloride, and vinyl fluoride; vinyl esters such as vinyl acetate, and vinyl propionate; vinyl ethers such as vinyl methyl ether, and vinyl ethyl ether; vinyl ketones such as vinyl methyl ketone, and methyl isopropenyl ketone; and nitrogen-containing vinyl compounds such as 2-vinylpyridine, 4-vinylpyridine, and N-vinylpyrrolidone. These monovinyl monomers may be used alone or in combination of two or more thereof. Out of these monomers, styrene, styrene derivatives, acrylic acid esters and methacrylic acid esters are preferably used as the monovinyl monomer.

The monovinyl monomer is preferably selected in such a manner that the glass transition temperature (hereinafter referred to as Tg) of a polymer obtained by polymerizing the monomer will be 80° C. or lower. About the monovinyl monomer, a single species thereof is used or two or more species thereof are used in combination, whereby the Tg of the polymer can be adjusted into a desired range.

For an improvement in hot offset, it is preferred to use, as a partial species of the polymerizable monomer, any crosslinkable monomer together with the monovinyl monomer. The crosslinkable monomer is a monomer having two or more polymerizable functional groups. Examples of the crosslinkable monomer include aromatic divinyl compounds such as divinylbenzene, divinylnaphthalene, and derivatives thereof; unsaturated polycarboxylic acid esters of polyhydric alcohols, such as ethylene glycol dimethacrylate, and diethylene glycol dimethacrylate; other divinyl compounds such as N,N-divinylaniline, and divinyl ether; and compounds having three or more vinyl groups. These crosslinkable monomers may be used alone or in combination of two or more thereof. It is desired to use the crosslinkable monomer in an amount of 0.1 to 5 parts by weight, preferably 0.3 to 2 parts by weight for 100 parts by weight of the monovinyl monomer.

It is further preferred to use, as another partial species of the polymerizable monomer, a macromonomer since a balance between the shelf stability and the low-temperature fixability of the resultant toner becomes good. The macromonomer is a compound having, at an end of the molecular chain thereof, a polymerizable carbon-carbon unsaturated double bond, and is a reactive oligomer or polymer having a number-average molecular weight of 1,000 to 30,000. The macromonomer is preferably a macromonomer which can give a polymer having a higher Tg than the Tg of the polymer obtained by polymerizing only a monovinyl monomer. The amount of the macromonomer is usually in the range from 0.01 to 10 parts by weight, preferably in the range from 0.03 to 5 parts by weight, even more preferably in the range from 0.05 to 1 part by weight for 100 parts by weight of the monovinyl monomer.

In the invention, it is preferred that the colored resin particles contain a charge control agent. When a toner having negative charge property is produced, a charge control agent having negative charge property is mainly used. When a toner having positive charge property is produced, a charge control agent having positive charge property is mainly used. It is allowable to use a small amount of a charge control agent having a polarity reverse to the polarity of the mainly used charge control agent.

Examples of the charge control agent having positive charge property include charge control resins such as polyamine resin, tertiary-ammonium-group-containing copolymer, and tertiary-ammonium-salt-group-containing copolymer; and, imidazole compounds, nigrosin dyes, tertiary ammonium salts, and triaminotriphenylmethane compounds.

Examples of the charge control agent having negative charge property include charge control resins such as sulfonic-acid-group-containing copolymer, sulfonic-acid-salt-group-containing copolymer, carbonxylic-acid-group-containing copolymer, and carboxylic-acid-salt-group-containing copolymer, and, azo dyes containing metals such as Cr, Co, Al and Fe, and, salicylic acid metal compounds, and, alkylsalicylic acid metal compounds.

In the invention, a charge control resin is preferably used as the charge control agent since the printing durability of the toner becomes good. When the charge control resin is used, the addition amount thereof is usually in the range from 0.01 to 30 parts by weight, preferably in the range from 0.3 to 25 parts by weight for 100 parts by weight of the binder resin.

In the polymerization of the polymerizable monomer, a molecular weight modifier is preferably used as a different additive. Examples of the molecular weight modifier include mercaptane compounds such as t-dodecylmercaptane, n-dodecylmercaptane, n-octylmercaptane, and 2,2,4,6,6-pentamethylheptane-4-thiol.

The polymerizable monomer composition yielded as described above is dispersed in an aqueous medium containing a dispersion stabilizer, and then a polymerization initiator is added thereto. Thereafter, the polymerizable monomer composition is formed into droplets. The method for forming the droplets is not particularly limited. The formation is conducted using a machine capable of performing strong agitation, examples of which include an inline type emulsification dispersing machine (trade name; EBARA MILDER, manufactured by Ebara Corp.), and a high-speed emulsification dispersing machine (trade name: T. K. HOMOMIXER MARK, Model II, manufactured by Tokushu Kiki Kogyo Co., Ltd.).

The aqueous medium may be water alone; however, a solvent soluble in water, such as a lower alcohol or a lower ketone, may be used together.

A dispersion stabilizer is contained into the aqueous medium. Examples of the dispersion stabilizer include metal compounds such as, sulfates such as barium sulfate, and calcium sulfate; carbonates such as barium carbonate, calcium carbonate, and magnesium carbonate; phosphates such as calcium phosphate; metal oxides such as aluminum oxide, and titanium oxide; metal hydroxides such as aluminum hydroxide, magnesium hydroxide, and ferric hydroxide, and include organic compounds such as, water-soluble polymers such as polyvinyl alcohol, methylcellulose, and gelatin; surfactants such as anionic surfactants, cationic surfactants, nonionic surfactants, and ampholytic surfactants. The dispersion stabilizers may be used alone or in combination of two or more thereof. Out of these dispersion stabilizers, the dispersion stabilizer containing a colloid of metal compounds, in particular, a colloid of hardly water-soluble metal hydroxides is preferred since the particle size distribution of the colored resin particles can be made narrow and the remaining amount of the dispersion stabilizer is small after the washing so that the resultant toner makes it possible to reproduce an image vividly and the environment stability is not deteriorated.

Examples of the polymerization initiator used to polymerize the polymerizable monomer composition include persulfates such as potassium persulfate, and ammonium persulfate; azo compounds such as 4,4'-azobis(4-cyanovaleric acid), 2,2'-azobis(2-methyl-N-(2-hydroxyethyl)propionamide, 2,2'-azobis(2-amidinopropane)dihydrochloride, 2,2'-azobis(2,4-dimethylvaleronitrile), and 2,2'-azobisisobutyronitrile; and organic peroxides such as di-t-butylperoxide, benzoylperoxide, t-butyl peroxy-2-ethylhexanoate, t-hexyl peroxy-2-ethylhexanoate, t-butyl peroxypivalate, diisopropyl peroxydicarbonate, di-t-butyl peroxyisophthlate, and t-butyl peroxyisobutylate. Redox initiators obtained by combining the polymerization initiators with a reducing agent may be used. It is preferred to use, out of these initiators, organic peroxides since the remaining amount of the polymerizable monomer can be made small and the durability is also good.

As described above, the polymerization initiator may be added after the polymerizable monomer composition is dispersed into an aqueous medium and before the composition is formed into droplets. The initiator may be added to the polymerizable monomer composition.

The addition amount of the polymerization initiator used to polymerize the polymerizable monomer composition is preferably in the range from 0.1 to 20 parts by weight, more preferably in the range from 0.3 to 15 parts by weight, most preferably in the range from 1.0 to 10 parts by weight for 100 parts by weight of the monovinyl monomer.

As described above, the polymerizable monomer composition is formed into droplets, and the resultant aqueous medium containing droplets of the polymerizable monomer composition is heated to initiate polymerization, thereby yielding an aqueous dispersion liquid of colored resin particles.

The polymerization temperature of the polymerizable monomer composition is preferably 50° C. or more, more preferably in the range from 60 to 95° C. The reaction time for the polymerization is preferably in the range from 1 to 20 hours, more preferably in the range from 2 to 15 hours.

The colored resin particles may be used as they are. The colored resin particles are preferably rendered the so-called core-shell structured colored resin particles, which are obtained by using the colored resin particles as a core layer and forming a shell layer different from the core layer outside the core layer. About the core-shell structured colored resin particles, a balance between a fall in the minimum fixing temperature (low-temperature fixability) and the prevention of aggregation of the particles when the particles is stored (the shelf stability) can be made good by covering the core layer, which is made of a low softening point material, with a material having a higher softening point than the low softening point.

The method for producing core-shell structured colored resin particles, using the above-mentioned colored resin particles obtained by polymerization methods, is not particularly limited; thus, the particles may be produced by a method known in the prior art. From the view point of production efficiency, an in-situ polymerization method or a phase separation method is preferred.

The method of producing the core-shell structured colored resin particles based on the in-situ polymerization method will be described hereinafter.

To the aqueous medium wherein the colored resin particles obtained by polymerization method are dispersed are added a polymerizable monomer for forming a shell layer (polymerizable monomer for shell) and a polymerization initiator, and then by polymerizing the aqueous medium, it possible to yield the core-shell structured colored resin particles.

As the polymerizable monomer for shell, compounds equivalent to the above-mentioned monovinyl monomers may be used. It is preferred that, out of the compounds, monomers which can each give polymer having a Tg higher than 80° C. are used alone or in combination of two or more thereof, examples of the monomers including styrene, acrylonitrile, and methyl methacrylate.

Examples of the polymerization initiator used to polymerize the polymerizable monomer for shell include water-soluble polymerization initiators such as, persulfuric acid metal salts such as potassium persulfate, and ammonium persulfate; azo compounds such as 2,2'-azobis(2-methyl-N-(2-hydroxyethyl)propionamide), and 2,2'-azobis-(2-methyl-N-(1,1-bis(hydroxymethyl)-2-hydroxyethyl)propionamide). The amount of the polymerization initiator is preferably in the range from 0.1 to 30 parts by weight, more preferably in the range from 1 to 20 parts by weight for 100 parts by weight of the polymerizable monomer for shell.

The aqueous dispersion liquid of the colored resin particles, obtained by the polymerization, are subjected to filtrating, washing for removal of the dispersion stabilizer, dehydrating, and drying operations in accordance with ordinary methods after the polymerization. In this way, polymerization-method-based colored resin particles are obtained.

In the case of using, as the dispersion stabilizer, an inorganic compound such as an inorganic hydroxide, the method for the above-mentioned washing is preferably a method of adding an acid or alkali to the aqueous dispersion liquid of the colored resin particles to dissolve the dispersion stabilizer in water and remove the stabilizer. In the case of using, as the dispersion stabilizer, a colloid of a hardly water-soluble inorganic hydroxide, it is preferred to add an acid thereto so as to adjust the pH of the aqueous dispersion liquid of the colored resin particles to 6.5 or less. The acid to be added may be an inorganic acid such as sulfuric acid, hydrochloric acid or nitric acid, or an organic acid such as formic acid, or acetic acid.

The method for the dehydration and the filtration may be one out of various known methods and so on, and is not particularly limited. Examples thereof include centrifugal filtration, vacuum filtration, and pressure filtration. The method for the drying is not particularly limited, either, and may be one out of various methods.

In the case of adopting a pulverization method as a dry method to produce the colored resin particles, the production is performed by a process described hereinafter. Specifically, at first, a binder resin, a colorant, an aliphatic hydrocarbon polymer, and a charge control agent used if desired are mixed with each other by use of a mixer such as a ball mill, a V-shaped mixer, a HENSCHEL MIXER, a high-speed dissolver, or an internal mixer. Next, the mixture obtained as described above is kneaded while heated, using a pressuring kneader, a monoaxial extruding kneader, a biaxial extruding kneader, rollers, or the like. The resultant kneaded product is pulverized into coarse particles, using a pulverizing machine such as a hammer mill, a cutter mill, or a roller mill. Furthermore, the resultant is pulverized into fine particles, using a pulverizing machine such as a jet mill, or a high-speed rotary pulverizer. Thereafter, the particles are classified into desired particle diameters by means of a classifier such as a wind power classifier or a gas-flow type classifier. In this way, pulverization-method-based colored resin particles are obtained. The colorant used in the pulverization method, and the charge control agent used if desired may be the same as described about the above-mentioned polymerization method. Ordinarily used addition amounts thereof, and preferred addition amounts thereof are the same parts by weight as in the above-mentioned case provided that the reference of 100 parts by weight of the monovinyl monomer should be replaced by a reference of 100 parts by weight of the binder resin.

The pulverization-method-based colored resin particles obtained as described above may be rendered core-shell structured colored resin particles by an in-situ polymerization method or some other method in the same manner as the polymerization-method-based colored resin particles.

About the toner of the invention, the colored resin particles may be used, as they are, as the toner, or the colored resin particles and carrier particles (such as ferrite or iron powder) may be used as the toner. In order to adjust the charge property, the flowability, the shelf stability and other properties of the toner, it is preferred to use a high-speed mixer (such as a HENSCHEL MIXER (trade name, manufactured by Mitsui Mining Co., Ltd.)) to mix the colored resin particles and external additives to prepare a one-component toner; or mix the colored resin particles, external additives, and carrier particles to prepare a two-component toner.

Examples of the external additives include inorganic fine particles of silica, titanium oxide, aluminum oxide, zinc oxide, tin oxide, calcium carbonate, calcium phosphate, and cerium oxide; and organic fine particles made of polymethylmethacrylate resin, silicone resin, and melamine resin. Particularly preferred are inorganic fine particles. Silica and titanium oxide are more preferred, and silica is even more preferred.

The addition amount of the additives is usually in the range from 0.1 to 6 parts by weight, preferably 0.2 part by weight or more and 5.0 parts by weight or less. It is preferred to use, as the external additives, two or more fine particle species together.

The volume average particle diameter (Dv) of the toner is preferably in the range from 3 to 15 μm, more preferably in the range from 4 to 12 μm. If the Dv is below the range, the flowability of the toner may lower, so as to deteriorate the transferability, blur may be generated or the image density may lower. If the Dv is over the range, the resolution of images may lower.

The ratio (Dv/Dp) of the volume average particle diameter (Dv) to the number average particle diameter (Dp), which represents the particle size distribution of the toner in the invention, is preferably in the range from 1.00 to 1.30, more preferably in the range from 1.00 to 1.20. If the ratio Dv/Dp is over this range, blur may be generated or the transferability, the image density and the resolution may lower. The Dv and the Dp may be measured with, for example, a particle size measuring device (trade name: MULTISIZER II, manufactured by Beckman Coulter Co.).

(Second Invention)

When the parting agent in the toner of the invention is an aliphatic hydrocarbon polymer (3) having characteristics (1) and (2) described below, the lowest fixability of the toner is improved. In this point, the toner exhibits a function similar to that of a low-softening point substance that has been hitherto used as a parting agent in toner. However, this toner, which is different from parting agents in the prior art, can be made compatible between an improvement in low-temperature fixability and an improvement in shelf stability or printing durability, in particular, an improvement in printing durability after the toner is stored at high temperature.

(1) The penetration (JIS K2235-1991) at 25° C. of the agent is 3 or less.

(2) The solubility thereof in toluene at 25° C. is in the range from 5 to 60% by weight.

(3) The agent is an aliphatic hydrocarbon polymer having the characteristics (1) and (2).

From the viewpoint of penetration, the peak top molecular weight of the aliphatic hydrocarbon polymer is preferably 5,000 or more, more preferably 10,000 or more. If the molecular weight is not more than the range, the printing durability of the resultant toner deteriorates easily after the high-temperature storage.

In the invention, the penetration at 25° C. for specifying an aliphatic hydrocarbon polymer is prescribed in JIS K2235-1991. The penetration is a numerical value measured at a sample temperature of 25° C. in accordance with the penetration test method of a petroleum wax. In the invention, the value of the penetration is denoted down to one decimal place.

A summary of the test method is as follows:

<Summary of Penetration Test Method>

A sample is heated and melted, and then collected into a sample vessel. The system is naturally cooled, and then kept at 25±0.1° C. in a thermostatic water bath. A predetermined needle, the total mass of which is set to 100 g, is penetrated vertically into the sample for 5 seconds. The penetration of the sample is represented as a numerical value (absolute number) obtained by measuring the depth in which the needle is penetrated to the depth of 0.1 mm and multiplying the measured value by 10.

About the aliphatic hydrocarbon polymer used in the toner of the invention, the penetration at 25° C. is 3 or less, preferably 2 or less, more preferably 1 or less.

When the penetration of the aliphatic hydrocarbon polymer at 25° C. is in the range, both of the low-temperature fixability and the durability after the toner is stored at high temperature are good.

On the other hand, if this penetration is larger than the range, the printing durability deteriorates after the high-temperature storage.

In the invention, the solubility of an aliphatic hydrocarbon polymer in toluene at 25° C. for specifying the polymer is a numerical value representing the content of a solute giving a saturated concentration in toluene at 25° C. In the invention, the solubility is represented by the ratio of the weight of the solute to the weight of the whole of the solution (the total of the solvent and the solute).

A summary of a testing method of the solubility of a parting agent is as follows:

<Summary of Test Method of Solubility of Parting Agent>

Toluene is heated to 30° C. or higher. Thereafter, while toluene is stirred, a parting agent is added thereto until the parting agent becomes unable to be dissolved therein, so as to yield a saturated solution of the parting agent. Thereafter, the resultant saturated solution is cooled to 25° C. (room temperature), and an undissolved fraction of the parting agent is filtrated through a filter to yield a saturated solution. Toluene in the resultant saturated solution is removed to measure the weight of the solute, and the concentration (% by weight) in the saturated solution is calculated out so as to obtain a value of the solubility.

In the invention, the solubility of the aliphatic hydrocarbon polymer in toluene at 25° C. is in the range from 5 to 60% by weight, preferably in the range from 5 to 50% by weight, more preferably in the range from 10 to 40% by weight.

When the solubility of the aliphatic hydrocarbon polymer at 25° C. is in the range, the compatibility between the aliphatic hydrocarbon polymer and other raw materials is high in the polymerization step conducted in the process of producing the colored resin particles by a suspension polymerization method or the like; thus, a sufficient amount of the aliphatic hydrocarbon polymer can be added to the raw materials.

On the other hand, if this solubility is smaller than the range, the distribution of the aliphatic hydrocarbon polymer in the raw materials becomes uneven unless the addition amount of the aliphatic hydrocarbon polymer is limited to a small amount in the polymerization step. If the process temperature in the polymerization reaction is made higher, even the aliphatic hydrocarbon polymer which has a small solubility can be added in a sufficient amount. In this case, however, the control of the polymerization reaction becomes difficult to cause a problem that the molecular weight of the binder resin cannot be appropriately adjusted, and other problems.

If this solubility is larger than the range, a problem is not particularly caused; however, the solubility not less than the range is not particularly required from the viewpoint of the compatibility between the aliphatic hydrocarbon polymer and the other raw materials.

In the second invention, the peak top molecular weight Mp of the α-olefin polymer is preferably in the range from 15,000 to 110,000, more preferably in the range from 20,000 to 100,000.

In the second invention, detailed description of the aliphatic hydrocarbon polymer other than the above is the same as in the first invention. Thus, the description is omitted.

The other additives, the producing process and so on of the toner according to the second invention are the same as in the description about the toner according to the first invention. Thus, the description thereof is omitted.

(Third Invention)

When the parting agent in the toner of the invention is an aliphatic hydrocarbon polymer (3) having characteristics (1) and (2) described below, the lowest fixability of the toner is improved. In this point, the toner exhibits a function similar to that of a low-softening point substance that has been hitherto used as a parting agent in toner. However, this toner, which is different from parting agents in the prior art, can be made compatible between an improvement in low-temperature fixability and an improvement in shelf stability or printing durability, in particular, an improvement in printing durability after the toner is stored at high temperature.

(1) The melting point (TmD) of the agent is 70° C. or lower.

(2) The penetration (FIS K2235-1991) at 25° C. of the agent is 3 or less.

(3) The agent is an aliphatic hydrocarbon polymer having the characteristics (1) and (2).

In the third invention, the melting point (TmD) of the parting agent is 70° C. or lower, preferably 40° C. or higher and lower than 70° C., more preferably 45° C. or higher and lower than 65° C. When the melting point is in the range, both of the shelf stability and the low-temperature fixability of the resultant toner are favorably excellent.

About the aliphatic hydrocarbon polymer used in the toner of the third invention, the penetration at 25° C. is 3 or less, preferably 2 or less, more preferably 1 or less. If the penetration is larger than the range, the shelf stability and the printing durability deteriorate. The penetration is measured in the same way as in the second invention.

In the third invention, the peak top molecular weight (Mp) of the parting agent is in the range from 10,000 to 100,000, more preferably in the range from 20,000 to 90,000. The weight-average molecular weight Mw of the parting agent is preferably in the range from 10,000 to 100,000, more preferably in the range from 20,000 to 90,000.

In the third invention, detailed description of the aliphatic hydrocarbon polymer other than the above is the same as in the first invention. Thus, the description is omitted.

The other additives, the producing process and so on of the toner according to the third invention are the same as in the description about the toner according to the first invention. Thus, the description thereof is omitted.

(Fourth Invention)

Furthermore, when the parting agent in the toner of the invention is:

(1) an aliphatic hydrocarbon polymer having a peak top molecular weight of 10,000 or more and a melting point of 70° C. or lower; and (2) a low molecular weight wax having a peak top molecular weight of 5,000 or less, the shelf stability, the low-temperature Fixability, the offset resistance and the printing durability of the toner can be improved.

In the fourth invention, the peak top molecular weight (Mp) of the aliphatic hydrocarbon polymer is more preferably in the range from 10,000 to 100,000, more preferably in the range from 20,000 to 90,000. When the peak top molecular weight of the aliphatic hydrocarbon polymer is in the range, a balance between the shelf stability and the low-temperature fixability of the toner is favorably good and the printing durability is also favorably excellent.

The melting point of the aliphatic hydrocarbon polymer is 70° C. or lower, preferably 40° C. or higher and lower than 70° C., more preferably 45° C. or higher and lower than 65° C. When the melting point of the aliphatic hydrocarbon polymer is in the range, a balance between the shelf stability and the low-temperature fixability of the resultant toner is favorably good and the printing durability is also favorably excellent.

In the fourth invention, detailed description of the aliphatic hydrocarbon polymer other than the above is the same as in the first invention. Thus, the description is omitted.

In the fourth invention, as the parting agent, a low molecular weight wax having a peak top molecular weight of 5,000 or less is used together with the above-mentioned specific aliphatic hydrocarbon polymer. The use of this low molecular weight wax gives an advantageous effect of improving the offset resistance.

Examples of the low molecular weight wax include natural waxes such as, animal and plant waxes such as candelilla, carnauba, rice wax, haze wax, and jojoba; petroleum waxes such as paraffin, microcrystalline and petrolactam, and modified waxes thereof; and other natural waxes; and include synthetic waxes such as, polyolefin waxes such as low molecular weight polyethylene, low molecular weight polypropylene and low molecular weight polybutylene; Fisher-Tropsch wax; ester waxes such as aliphatic acid esters of linear saturated monohydric alcohol, aliphatic acid esters of glycerin, aliphatic acid esters of pentaerythritol, aliphatic acid esters of diglycerin, aliphatic acid esters of dipentaerythritol, and aliphatic acid esters of polyglycerin; ester amide waxes; ketone waxes; and substituted urea compounds; and other synthetic waxes. Out of these waxes, ester waxes are preferred.

Out of the ester waxes, preferred is a compound having a branch number of 3 or more from the viewpoint of the solubility into the monomer(s) in the synthesis of the toner. Specific examples thereof include glycerin tristearate, glycerin tribehenate, pentaerythritol tetrapalmitate, pentaerythritol tetrastearate, diglycerin tetrapalmitate, diglycerin tetrastearate, dipentaerythritol hexamyristate, and dipentaerythritol hexapalmitate.

The peak top molecular weight (Mp) of the low molecular weight wax used together with the aliphatic hydrocarbon polymer is preferably in the range from 500 to 5,000, more preferably in the range from 1,000 to 4,500. The peak top molecular weight is measured in the same way as about the aliphatic hydrocarbon polymer.

The melting point of the low molecular weight wax is preferably in the range from 50 to 100° C., more preferably in the range from 60 to 90° C., and is preferably equal to or higher than the melting point of the aliphatic hydrocarbon polymer. The difference of the melting point of the low molecular weight wax from the melting point of the aliphatic hydrocarbon polymer is preferably 50° C. or lower, more preferably 30° C. or lower, even more preferably 20° C. or lower. When the melting point of the low molecular weight wax is in the range, both of the shelf stability and the low-temperature fixability of the resultant toner are favorably excellent.

In the fourth invention, the content of the parting agent is preferably in the range from 4 to 60 parts by weight, more preferably in the range from 6 to 50 parts by weight, even more preferably in the range from 8 to 40 parts by weight for 100 parts by weight of the binder resin. The ratio by content of the aliphatic hydrocarbon polymer to the low molecular weight wax (the content of the aliphatic hydrocarbon polymer/the content of the low molecular weight wax) in the parting agent is preferably in the range from 98/2 to 25/75, more preferably in the range from 96/4 to 50/50, even more preferably in the range from 94/6 to 55/45. When the content of the parting agent is in this range, the advantageous effects of the specific parting agent in the present application can be sufficiently obtained.

The other additives, the producing process and so on of the toner according to the fourth invention are the same as in the description about the toner according to the first invention. Thus, the description thereof is omitted.

EXAMPLES

The invention will be described in more detail by way of the following examples; however, the invention is not limited to the examples. The word "part(s)" and the symbol "%" mean "part(s) by weight" and "% by weight", respectively, unless otherwise specified.

Example Series I

Test methods made in the present examples are as follows:

(1) Measurement of Thermal Characteristics of a Wax According to Differential Scanning Calorimetry (DSC)

A differential scanning calorie analyzer (trade name: RDC-220, manufactured by Seiko Instruments Inc.) was used to measure thermal characteristics of a wax, such as the melting point thereof. The wax was weighed by weight of 6 to 8 mg, and the weighed wax was put into a sample holder. The sample was measured under the condition that the temperature was raised from −20° C. to 100° C. at 10° C./minute to give a DSC curve. In this way, the melting point (TmD) and the half value width of a peak were obtained.

In Table I-1, waxes about which two melting points (TmD) are described each show that the DSC curve thereof has two peaks. About the half value width of the wax having the multiple peaks, the half value width being described in Table I-1, is the summation of the width having the individual peaks when the individual peaks are separated from each other, and is the width in the overlapped portions when the individual peaks are overlapped at the half value of the highest peaks. When the individual peaks are separated from each other, the summation of the half value widths of the peaks is described as the half value width of the wax having the peaks in Table I-1. When the individual peaks are overlapped at the half value of the highest peaks of the individual peaks, the width in the overlapped portions is described therein.

(2) Toner Particle Diameter

The volume average particle diameter Dv of the toner, and the particle size distribution (Dv/Dp) of the toner represented by the ratio of the volume average particle diameter Dv of the toner to the number average particle diameter Dp of the toner were measured with a particle diameter measuring device (trade name: MULTISIZER II, manufactured by Beckman Coulter Co.). About conditions for the measurement, the aperture diameter was 100 μm, the medium was ISOTON II, the concentration was 10%, and the number of measured particles was 100,000.

Specifically, 5 to 20 mg of a sample of the toner was collected into a beaker, and thereto was added 0.1 to 1 mL of a surfactant, preferably an alkylbenzenesulfonic acid. To this beaker was further added 0.5 to 2 mL of ISOTON II so as to get the toner wet. Thereafter, thereto was further added 10 to 30 mL of ISOTON II, and the toner was dispersed with an ultrasonic disperser for 1 to 3 minutes. Thereafter, a measurement was made with the particle diameter measuring device.

(3) Shelf Stability of a Toner 10 grams of a toner was put into a hermetically-sealable container (made of polyethylene, volume: 100 mL), and then the container was hermetically sealed. Thereafter, the container was sunk into a thermostatic water tank the temperature of which was kept at 55° C. After 15 hours, the container was taken out from the thermostatic water tank, and the toner in the container was put on a 42-mesh sieve. At this time, the toner was gently taken out from the container and further the toner was carefully shifted and put onto the sieve not to break the aggregation structure of the toner in the container. The above-mentioned powder measuring device (trade name: Powder Tester, manufactured by Hosokawa Micron Corp.) was used to vibrate the sieve on which the toner was put under a condition that the amplitude was 1 mm for 30 seconds. Thereafter, the weight of the toner remaining on the sieve was measured, and the measured value was used as the weight of the aggregated toner. The ratio (% by weight) of the weight of the aggregated toner to the weight of the toner put firstly into the container was calculated out. The measurement was made three times per sample. The average thereof was used as an index of the shelf stability.

(4) Volume Resistivity of a Toner

A molding machine (trade name: BPM-30 Model, manufactured by Maekawa testing Machine Mfg. Co., Ltd.) was used to press-mold 3.9 g of a toner at a pressure of 100 kgf/cm$^2$ for 1 minute, thereby yielding a disc-form measuring sample having a diameter of 5 cm and a thickness of 2 mm. The resultant measuring sample was measured with a dielectric loss measuring device (trade name: TRS-10 model, manufactured by Ando Electric Co., Ltd.) at a temperature of 30° C. and a frequency of 1 kHz. In this way, the volume resistivity was obtained.

(5) Minimum Fixing Temperature of a Toner (Low-temperature Fixability)

A printer remodeled to be capable of varying the temperature of a fixing roller section in a commercially available printer (printing speed: 22 A4-size sheets per minute) in a nonmagnetic one-component developing manner was used to make a fixing test. In the fixing test, a black plain pattern image (image density: 100%) was printed while the temperature of the fixing roller in the remodeled printer was varied. The fixing rate of the toner was measured at individual temperatures to obtain a relationship between the temperature and the fixing rate.

The fixing rate was obtained by peeling a tape in the black plain pattern printed region (image density: 100%) and calculating the rate between the image densities before and after the peeling of the tape. Specifically, when the image density before the tape was peeled is represented by ID (before) and the image density after the tape was peeled is represented by ID (after), the fixing rate can be calculated in accordance with the following equation:

$$\text{fixing rate (\%)}=(ID(\text{after})/ID(\text{before}))\times 100$$

The peeling of the tape is composed of a series of operations of causing the tape, which was an adhesive tape (trade name: Scotch Mending Tape 810-3-18, manufactured by Sumitomo 3M Ltd.), to adhere onto a region to be measured of the test sheet, pressing the tape at a predetermined pressure to stick the tape on the sheet, and then peeling the adhesive tape at a constant speed along the direction parallel to the sheet. The image density was measured by use of a reflection image densitometer (trade name: RG914, manufactured by Macbeth Co.).

In this fixing test, the minimum fixing roller temperature at which the fixing rate was over 80% was evaluated as the fixing temperature of the toner.

Production Example I-1

Wax I-A

Catalyst Production Example

Production of (1,2'-dimethylsilylene)(2,1'-dimethylsilylene)bis(3-trimethylsilylmethylindenyl)zirconium dichloride:

In a flow of nitrogen gas, into a 200-mL Schlenk bottle were charged 2.5 g (7.2 mmol) of (1,2'-dimethylsilylene)(2,1'-dimethylsilylene)bis(indene) and 100 mL of ether, and then the system was cooled to −78° C. Thereto was added 9.0 mL (14.8 mmol) of a n-butyllithium (n-BuLi) solution (concentration: 1.6 mol/L) in hexane. The temperature of the system was again returned to room temperature, and the solution was stirred for 12 hours.

The solvent was distilled off from the resultant solution, and the remaining solid was washed with 20 mL of hexane. Thereafter, the solid was dried under reduced pressure to yield a lithium salt of (1,2'-dimethylsilylene)(2,1'-dimethylsilylene)bis(indene) quantitatively as a white solid.

Next, in the Schlenk bottle, the resultant lithium salt (6.97 mmol) of (1,2'-dimethylsilylene)(2,1'-dimethylsilylene)bis(indene) was dissolved into 50 mL of tetrahydrofuran (THF), and at room temperature thereto was dropwise and slowly added 2.1 mL (14.2 mmol) of iodomethyltrimethylsilane. The solution was stirred for 12 hours.

After the stirring, the solvent was distilled off, and 50 mL of ether was added to the solution. Furthermore, thereto was added a saturated solution of ammonium chloride in water so as to perform washing. The aqueous phase was separated away, and the organic phase was dried to remove the solvent, thereby yielding 3.04 g (5.9 mmol) of (1,2'-dimethylsilylene)(2,1'-dimethylsilylene)bis(3-trimethylsilylmethylindene) (yield; 84%).

In a flow of nitrogen gas, into a Schlenk bottle was charged 3.04 g (5.9 mmol) of (1,2'-dimethylsilylene)(2,1'-dimethylsilylene)bis(3-trimethylsilylmethylindene) and 50 mL of ether, and then the system was cooled to −78° C. Thereto was added 7.4 mL (11.8 mmol) of a n-butyllithium (n-BuLi) solution (concentration: 1.6 mol/L) in hexane. Thereafter, the temperature of the system was returned to room temperature, and the solution was stirred for 12 hours.

After the stirring, the solvent was distilled off from the solution, and the remaining solid was washed with 40 mL of hexane to yield 3.06 g of an ether adduct of the lithium salt.

A 1H-NMR of this ether adduct of the lithium salt was obtained. The following results were obtained.

1H-NMR (90 MHz, THF-d8): δ 0.04 (s, —SiMe3, 18H), 0.48 (s, —Me2Si—, 12H), 1.10 (t, —CH3, 6H), 2.59 (s, —CH2-, 4H), 3.38 (q, —CH2-, 4H), 6.2-7.7 (m, Ar—H, 8H)

In a flow of nitrogen gas, 3.06 g of the ether adduct of the lithium salt, which was obtained as described, was suspended into 50 mL of toluene, and the system was cooled to −78° C. Thereto was dropwise added a suspension of 1.2 g (5.1 mmol) of zirconium tetrachloride in toluene (20 mL), which was beforehand cooled to −78° C., and then the temperature of the system was returned to room temperature. The suspension was then stirred for 6 hours.

The solvent in the resultant solution was distilled off, and the remaining solid was recrystallized from dichloromethane to yield 0.9 g (1.33 mmol) of a yellow microcrystal of (1,2'-dimethylsilylene)(2,1'-dimethylsilylene)bis(3-trimethylsilylmethylindenyl)zirconium dichloride (yield: 26%).

A 1H-NMR of this yellow microcrystal was obtained. The following results were obtained.

1H-NMR (90 MHz, CDCl3): δ 0.0 (s, —SiMe3-, 18H), 1.02, 1.12 (s, —Me3Si—, 12H), 2.51 (dd, —CH2-, 4H), 7.1-7.6 (m, Ar—H, 8H)

(α-Olefin Polymerization)

Into a heated and dried 10-L autoclave were charged 3 L of α-olefin (trade name: "LINEAREN 2024", manufactured by Idemitsu Kosan Co., Ltd.) (a mixture made mainly of α-olefins having 20, 22 and 24 carbon atoms, and having the composition of C18 or less: 4.2%, C20: 41.9%, C22: 36.2%, C24: 16.9%, and C26: 0.8%), and 3 L of heptane, and then the temperature of the system was raised to a polymerization temperature of 80° C. Thereafter, thereto were added 15 mmol of triisobutylaluminum, 60 μmol (toluene slurry [20 μmol/mL, 3 mL]) of (1,2'-dimethylsilylene)(2,1'-dimethylsilylene)bis(3-trimethylsilylmethylindenyl)zirconium dichloride, yielded in Catalyst Production Example described above, and 240 μl (toluene slurry [20 μmol/mL, 12 mL]) of dimethylanilinium tetrakispentafluorophenylborate, and then hydrogen was introduced into the system to give a pressure of 0.08 MPa, and polymerization was conducted for 4 hours.

After the end of the polymerization reaction, the reactant was precipitated with acetone, and then the precipitation was heated and dried under reduced pressure to yield 2.0 kg of a higher α-olefin polymer as a wax I-A. About the resultant wax I-A, the Mw was 48,000, the Mw/Mn was 1.9, the TmD was 52.0° C., and the half value width was 8° C.

Production Example I-2

Wax I-B

Preparation of a Monomer

α-Olefin (trade name: "LINEAREN 2024", manufactured by Idemitsu Kosan Co., Ltd.), which was used in above-mentioned Production Example I-1, was distilled at a distilling temperature of 140 to 230° C. under a reduced pressure (in the range from 2 to 14 mmHg) to yield α-olefin fractions having a composition of C22: 63.5%, and C24: 36.5%. The resultant α-olefin fractions were introduced into a heated and dried 5-L Schlenk, and subjected to dehydrating treatment with dry nitrogen and active alumina for 8 hours.

(α-Olefin Polymerization)

Into a heated and dried 10-L autoclave were charged 5 L of the dehydrated α-olefin fractions, and the temperature of the system was raised to a polymerization temperature of 75° C. Thereafter, thereto were added 12 mmol of triisobutylaluminum, 25 μmol (toluene slurry [20 μmol/mL, 1.25 mL]) of (1,2'-dimethylsilylene)(2,1'-dimethylsilylene)bis(3-trimethylsilylmethylindenyl)zirconium dichloride, which was yielded in above-mentioned Catalyst Production Example, and 100 μmol (toluene slurry [20 μmol/mL, 5 mL]) of dimethylanilinium tetrakispentafluorophenylborate. Hydrogen was introduced thereinto so as to give a pressure of 0.05 MPa, and polymerization was conducted for 4 hours.

After the end of the polymerization reaction, the reactant was precipitated with acetone, and then the precipitation was heated and dried under reduced pressure to yield 1.7 kg of a higher α-olefin copolymer as a wax I-B. About the resultant wax I-B, the Mw was 53,000, the Mw/Mn was 1.9, the TmD was 62.0° C., and the half value width was 6° C.

Example I-1

A media type dispersing machine was used to wet-pulverize 81 parts of styrene and 19 parts of n-butyl acrylate (the Tg of a copolymer obtained by copolymerizing these monomers was 55° C.) as monovinyl monomers, 0.3 part of a polymethacrylic acid ester macromonomer (trade name: AA6, manufactured by Toagosei Co., Ltd.; Tg=94° C.) as a macromonomer, 0.5 part of divinylbenzene as a crosslinkable monomer, 1.2 parts of t-dodecylmercaptane as a molecular weight modifier, and 7 parts of carbon black (trade name: #25B, manufactured by Mitsubishi Chemical Corp.) as a black colorant. To the mixture obtained by the wet pulverization were added 1 part of a charge control resin (trade name: ACRYBASE FCA-207P, manufactured by Fujikura Kasei Co., Ltd.) as a charge control agent, and 10 parts of the wax I-A yielded in Production Example I-1. The components were then mixed, and the predetermined components were dissolved to prepare a polymerizable monomer composition.

Separately, an aqueous solution wherein 4.5 parts of sodium hydroxide were dissolved in 50 parts of ion-exchanged water was gradually added to an aqueous solution wherein 8.1 parts of magnesium chloride were dissolved in 170 parts of ion-exchanged water while the solution was stirred, so as to prepare a colloid dispersion liquid of magnesium hydroxide.

Separately, an ultrasonic emulsifier was used to subject 1 part of methyl methacrylate (the Tg of the polymer to be obtained was 105° C.) and 65 parts of water to finely-dispersing treatment, so as to yield an aqueous dispersion liquid of a polymerizable monomer for shell.

The polymerizable monomer composition was added to the colloid dispersion liquid of magnesium hydroxide (magnesium hydroxide colloid amount: 3.3 parts) obtained as described above, and further the resultant was stirred. Thereto were added 6 parts of t-butyl peroxy-isobutylate (trade name: PERBUTYL IB, manufactured by NOF Corporation) as a polymerization initiator. The dispersion liquid to which the polymerization initiator was added was subjected to dispersion with an in-line type emulsification dispersing machine (trade name: EBARA MILDER MDN303V, manufactured by Ebara Corp.) at a rotation number of 15,000 rpm, so as to form droplets of the polymerizable monomer composition.

The dispersion liquid wherein the droplets were formed was put into a reactor, and the temperature thereof was raised to 95° C. to conduct polymerization reaction. After the polymerization conversion rate reached to substantially 100%, into the aqueous dispersion liquid of the polymerizable monomer for shell was dissolved 0.1 part of 2,2'-azobis(2-methyl-N-(2-hydroxyethyl)-propionamide) (trade name: VA-086, manufactured by Wako Pure Chemical Industries, Ltd.; water-soluble) as a polymerization initiator for shell, and the resultant was added to the reactor. Furthermore, the system was kept at 95° C. for 4 hors to continue the polymerization. Thereafter, the reactor was cooled with water to stop the reaction, thereby yielding an aqueous dispersion liquid of core-shell structured colored resin particles.

While the resultant aqueous dispersion liquid of the colored resin particles was stirred, washing with acid on the basis of addition of sulfuric acid was performed (at 25° C. for 10 minutes) until the pH turned to 4.5 or less. Thereafter, the resultant was filtrated, dehydrated, and dried to yield dried colored resin particles.

To 100 parts of the dried colored resin particles were added 1 part of silica fine particles (number-average primary particle diameter: 7 nm) subjected to hydrophobicity-imparting treatment with cyclic silazane, and 1 part of silica fine particles (number-average primary particle diameter: 35 nm) subjected to hydrophobicity-imparting treatment with amino-modified silicone oil. The components were mixed by use of a high-speed mixer (trade name: HENSCHEL MIXER, manufactured by Mitsui Mining Co., Ltd.), so as to prepare a nonmagnetic one-component toner for developing electrostatic image. The test results are shown in Table I-2.

Example I-2

A toner for developing electrostatic image was prepared in the same way as in Example I-1 except that the wax I-B yielded in Production Example I-2 was used instead of the wax I-A in Example 1. The test results are shown in Table 1-2.

Comparative Example I-1

A toner for developing electrostatic image was prepared in the same way as in Example I-1 except that in Example I-1, a commercially available wax I-C (trade name: VYBER253, manufactured by Toyo-Petrolite Co., Ltd.) was used instead of the wax I-A and the processing from the dissolution of the wax to the rise in the temperature in the polymerization was carried out in the state that the dispersion liquid wherein the polymerizable monomer composition or the droplets thereof were dispersed was kept at 50° C. while heated. The test results are shown in Table I-2.

Comparative Example I-2

A toner for developing electrostatic image was prepared in the same way as in Example I-1 except that in Example I-1, a wax I-D (trade name: WEISSEN-T-68, manufactured by Nippon Seiro Co., Ltd.) was used instead of the wax I-A and the processing from the dissolution of the wax to the rise in the temperature in the polymerization was carried out in the state that the dispersion liquid wherein the polymerizable monomer composition or the droplets thereof were dispersed was kept at 50° C. while heated. The test results are shown in Table I-2.

Comparative Example I-3

A toner for developing electrostatic image was prepared in the same way as in Example I-1 except that in Example I-1, a commercially available wax I-E (trade name: WEP6, manufactured by NOF Corporation.) was used instead of the wax I-A and the processing from the dissolution of the wax to the rise in the temperature in the polymerization was carried out in the state that the dispersion liquid wherein the polymerizable monomer composition or the droplets thereof were dispersed was kept at 50° C. while heated. The test results are shown in Table I-2.

Table I-1 described below shows physical properties of the waxes I-A and I-B yielded in the above-mentioned Production Examples and used in the Examples of the invention, and the commercially available waxes I-C, I-D and I-E used in the Comparative Examples.

TABLE 1

Table I-1

| | Wax I-A | Wax I-B | Wax I-C | Wax I-D | Wax I-E |
|---|---|---|---|---|---|
| Wax species | Higher α-olefin polymer | Higher α-olefin polymer | Higher α-olefin polymer | Higher α-olefin polymer | Ester wax |
| (DSC measurement) | | | | | |
| The number of melting point(s) TmD(s) | 1 | 1 | 2 | 2 | 1 |
| Melting point(s) TmD(s) (° C.) | 52.0 | 62.0 | 46.5<br>63.3 | 43.8<br>46.7 | 76.0 |
| Half value width (° C.) | 8 | 6 | 9 | 14 | 5 |

TABLE 2

Table I-2

| | Example I-1 | Example I-2 | Comparative Example I-1 | Comparative Example I-2 | Comparative Example I-3 |
|---|---|---|---|---|---|
| Wax Used | Wax I-A | Wax I-B | Wax I-C | Wax I-D | Wax I-E |
| (Toner characteristics) | | | | | |
| Volume average particle diameter Dv (μm) | 8.9 | 8.7 | 8.4 | 8.4 | 8.6 |
| Particle size distribution Dv/Dp | 1.13 | 1.14 | 1.28 | 1.38 | 1.12 |

TABLE 2-continued

Table I-2

| | Example I-1 | Example I-2 | Comparative Example I-1 | Comparative Example I-2 | Comparative Example I-3 |
|---|---|---|---|---|---|
| Volume resistivity (logΩ/cm) | 11.3 | 11.4 | 11.0 | 11.0 | 11.3 |
| Shelf stability (% by weight) | 1 or less | 1 or less | 100 | 100 | 1 or less |
| Minimum fixing temperature (° C.) | 145 | 150 | 165 | 175 | 165 |

From the test results described in Table I-2, the following are understood.

About the toner of Comparative Example I-1, which contained the wax C having two melting points (TmD) each defined as a peak top temperature in the DSC curve thereof according to the Differential Scanning Calorimetry (DSC), the toner was completely aggregated by the shelf stability test, and the minimum fixing temperature was high. Thus, both of the shelf stability and the low-temperature fixability were insufficient.

About the toner of Comparative Example I-1, which contained the wax I-D having two melting points (TmD) in the same manner as the wax I-C and having a peak half value width more than 10° C., the toner was completely aggregated by the shelf stability test, and the minimum fixing temperature was higher than that of the toner of Comparative Example 1-1. Thus, both of the shelf stability and the low-temperature fixability were insufficient.

About the toner of Comparative Example I-3, which contained the wax E, which was an ester wax, the shelf stability was good but the minimum fixing temperature was high. Thus, the low-temperature fixability was insufficient.

On the other hand, about the toners of the Examples, which each contained a specific higher α-olefin polymer prescribed in the invention, both of the shelf stability and the low-temperature fixability were good.

Example Series II

Test methods made in the present examples are as follows:

(1) Measurement of thermal characteristics of a parting agent according to Differential Scanning Calorimetry (DSC)

Thermal characteristics of a parting agent, such as the melting point thereof, were measured in the same way as in Example Series I.

(2) Penetration at 25° C.

Measurement thereof was made in accordance with the penetration testing method prescribed in JIS K2235-1991. An automatic penetration meter (trade name: RPM-101, manufactured by Rigo Co., Ltd.) was used as a device for measuring the penetration.

(3) Solubility of a Parting Agent at 25° C.

After 100 g of toluene put into a 500 mL container was heated to 40° C., a parting agent was added thereto while the toluene was stirred until the parting agent became unable to be dissolved. In this way, a saturated solution of the parting agent was obtained. Thereafter, the resultant saturated solution was cooled to 25° C. (room temperature), and an undissolved fraction of the parting agent was filtrated through a filter to yield a saturated solution. Toluene in the resultant saturated solution was removed, and the parting agent, which was a solute, was weighed. The concentration (% by weight) in the saturated solution was then calculated out to give a value of the solubility.

(4) Molecular Weight of a Parting Agent

The molecular weight of a parting agent was obtained as a polystyrene-converted molecular weight measured by gel permeation chromatography (GPC).

Specifically, the measuring device used therein was a GPC measuring device (trade name: Alliance GPC2000, manufactured by Waters Co.). The solution used to be injected was 240 μL of a solution in 1,2,4-trichlorobenzene (and containing dibutylhydroxytoluene at 300 ppm) having a concentration of 0.5 mg/mL. The used column was a mixed polystyrene gel column (trade name: GMHHR-H(S)HT, manufactured by Tosoh Corp.). The molecular weight was obtained by measurement at a column temperature of 145° C. and a flow rate of 1.0 mL/min. For detection, an infrared ray detector was used, and a wavelength of 3.41 μm was used.

(5) Toner Particle Diameter

The volume average particle diameter Dv of the toner, and the particle size distribution (Dv/Dp) of the toner represented by the ratio of the volume average particle diameter Dv of the toner to the number average particle diameter Dp of the toner were measured with a particle diameter measuring device (trade name: MULTISIZER II, manufactured by Beckman Coulter Co.). Conditions for the measurement were as follows: aperture diameter=100 μm, medium ISOTON II, concentration=10%, and the number of measured particles=100,000.

Specifically, 0.2 g of a toner sample was collected into a beaker, and thereto was added a solution of alkylbenzenesulfonic acid in water (trade name: DRYWELL, manufactured by Fuji Photo Film Co., Ltd.) as a dispersing agent. Thereto was further added 2 mL of ISOTON II to get the toner wet. Thereafter, thereto was added 10 mL of ISOTON II, and the solution containing the toner was dispersed for 1 minute with an ultrasonic disperser. The resultant was then subjected to measurement with the above-mentioned particle diameter measuring device.

(6) Volume Resistivity of a Toner

Measurement was made in the same way as in Example Series I so as to obtain the volume resistivity.

(7) Minimum Fixing Temperature of a Toner (Low-Temperature Fixability)

Measurement was made in the same way as in Example Series I so as to evaluate the low-temperature fixability.

(8) Shelf Stability of a Toner

Measurement was made in the same way as in Example Series I.

(9) Printing Durability

A toner was put into a commercially available printer (printing speed: 24 A4-size sheets per minute) in a nonmagnetic one-component developing manner, and continuous printing was made at an image density of 5% from the start in an environment of 23° C. temperature and 50% relative humidity (normal temperature and normal humidity). In printing on a $500^{th}$ sheet, plain pattern printing (image density: 100%) and white pattern printing (image density: 0%) were made, and the following was examined: the number of continuously printed sheets which were able to keep such an image quality that the image density measured with a reflection type image density measuring device (trade name: RD914, manufactured by Macbeth Co.) was 1.3 or more about the plain pattern printing and further the fog on the photosensitive member subjected to developing treatment, which was measured with a whiteness calorimeter (manufactured by Nippon Denshoku Industries Co., Ltd.), was a value of 5% or less about the white plain pattern printing. In this way, the durability of the toner was evaluated.

Specifically, the fog was measured as follows: the toner on the photosensitive member subjected to developing treatment was peeled off by use of an adhesive tape (Scotch Mending Tape 810-3-18, manufactured by Sumitomo 3M Ltd.), and the tape was caused to adhere onto a new printing sheet to measure the whiteness B (%) thereof; separately, the whiteness A (%) of a new printing sheet onto which only an adhesive tape was caused to adhere was measured: and the fog was calculated out according to the following equation:

$$\text{fog (\%)} = \text{whiteness } A - \text{whiteness } B$$

(10) Printing durability (After High-Temperature Standing)

Into a toner cartridge was put 400 g of a toner, and this cartridge was hermetically sealed with an aluminum bag. Thereafter, the resultant was sunk into a thermostatic water tank, the temperature of which was kept at 50° C. After 5 days, the cartridge was taken out from the thermostatic water tank. About subsequent operations, the same manner as in the item (9) was performed to test the printing durability.

Production Example II-1

Wax II-A

A higher α-olefin polymer was yielded in the same way as the wax I-A in Production Example I-1. This was used as a wax II-A.

Production Example II-2

Wax II-B

A higher α-olefin polymer was yielded in the same way as the wax I-D in Production Example I-1. This was used as a wax II-B.

Production Example II-3

Wax II-C

Commercially available pentaerythritol tetrastearate (trade name: WEP6, manufactured by NOF Corporation.) was dissolved into toluene heated to 40° C. to prepare a 20% by weight solution. Thereafter, the solution was cooled to 5° C. to recrystallize pentaerythritol tetrastearate. While the temperature was kept at 5° C., the recrystallized component was filtrated through a filter paper piece. The recrystallized component on the filter paper piece was vacuum-dried at 50° C. for 24 hours to yield a wax II-C.

Analytical results and characteristics of the waxes produced in the Production Examples and the various commercially available waxes are shown in Table II-1.

TABLE 3

Table II-1

| | Wax species | | | | |
|---|---|---|---|---|---|
| | Wax II-A (α-olefin polymer) | Wax II-B (α-olefin polymer) | PW130 (paraffin wax) | WEP6 (ester wax) | Wax II-C (ester wax) |
| Melting point(s) (TmD) (° C.) | 52 | 62 | 34.56 | 76 | 77 |
| Half value width (° C.) | 8 | 6 | 15 | 5 | 5 |
| Penetration (25° C.) | 1.4 | 2.1 | 13.1 | 5.8 | 5.6 |
| Solubility (wt %) in toluene | 25 | 18 | 3 | 5 | 5 |
| Peak top molecular weight (Mp) | 46,000 | 38,000 | 1,300 | 2,500 | 2,500 |
| Weight-average molecularweight (Mw) | 47,000 | 43,000 | 1,400 | 2,500 | 2,500 |
| Number-average molecularweight (Mn) | 28,000 | 27,000 | 1,300 | 2,400 | 2,400 |
| Molecular weight distribution (Mw/Mn) | 1.7 | 1.6 | 1.0 | 1.1 | 1.1 |

* About PW130, two peaks were present in the DSC curve thereof, and two melting points TmD were present.

Example II-1

A toner was yielded in the same way as in Example I-1.

Example II-2

A toner was yielded in the same way as in Example II-1 except that in Example II-1, the wax II-B yielded in Production Example II-2 was used instead of the wax II-A as the parting agent.

Comparative Example II-1

A toner was yielded in the same way as in Example II-1 except that in Example II-1, a commercially available paraffin wax (trade name: PW130, manufactured by Nippon Seiro Co., Ltd.) was used instead of the wax II-A as the parting agent, and the processing from the dissolution of the parting agent to the polymerization was carried out in the state that the monomer composition, the dispersing agent, and the mixture thereof were heated to 50° C. or higher.

Comparative Example II-2

A toner was yielded in the same way as in Example II-1 except that in Example II-1, a commercially available ester wax (trade name: WEP6, manufactured by NOF Corporation.) was used instead of the wax II-A as the parting agent, and the processing from the dissolution of the parting agent to the polymerization was carried out in the state that the monomer composition, the dispersing agent, and the mixture thereof were heated to 40° C. or higher.

Comparative Example II-3

A toner was yielded in the same way as in Example II-1 except that in Example II-1, the wax II-C yielded in Production Example II-3 was used instead of the wax II-A as the parting agent.

The results of the Examples and the Comparative Examples are shown in Table II-2.

TABLE 4

Table II-2

| | Example II-1 | Example II-2 | Comparative Example II-1 | Comparative Example II-2 | Comparative Example II-3 |
|---|---|---|---|---|---|
| Wax species | Wax II-A | Wax II-B | PW130 | WEP6 | Wax II-C |
| Volume average particle diameter Dv (μm) | 7.6 | 7.9 | 7.7 | 7.4 | 7.4 |
| Particle size distribution (Dv/Dp) | 1.15 | 1.14 | 1.21 | 1.16 | 1.15 |
| Volume resistivity (log(Ω · cm)) | 11.3 | 11.4 | 11.0 | 11.4 | 11.4 |
| Minimum fixing temperature (° C.) | 145 | 150 | 150 | 165 | 165 |
| Shelf stability (wt %) | 1 or less | 1 or less | 100 | 1 or less | 1 or less |
| Printing durability (number of sheets) | 17,000 | 17,000 | 10,000 | 14,000 | 16,000 |
| Printing durability (number of sheets) after high-temperature standing | 16,500 | 16,500 | 5,000 | 12,000 | 14,000 |

(Summary of the Results)

In Examples IS-1 and II-2, the α-olefin polymer wax (wax II-A or II-B), wherein the penetration and the solubility in toluene satisfied the requirements specified in the invention, was used as a parting agent. As a result, the minimum fixing temperature was low and additionally blocking was hardly generated in the shelf stability test. Furthermore, the number of sheets wherein fog was generated was very large in both of the ordinary printing durability test and the printing durability test after high-temperature standing. In particular, the examples were characterized in that the number of sheets wherein fog was generated in the printing durability test after high-temperature standing was not very different from that of the sheet wherein fog was generated in the ordinary printing durability test.

On the other hand, in Comparative Example II-1, wherein the commercially available paraffin wax was used, the minimum fixing temperature of the toner was equivalent to those of Examples II-1 and I-2; however, in the shelf stability test, blocking was completely generated (100%.), and the number of printed sheets wherein fog was generated was very small in both of the ordinary printing durability test and the printing durability test after high-temperature standing. In particular, the number of printed sheets wherein fog was generated in the printing durability test after high-temperature standing was 5,000, and the fog was generated very early from the start of the continuous printing.

In Comparative Example II-2, wherein the commercially available ester wax WEP6 was used, the minimum fixing temperature of the toner was higher than those of Examples II-1 and II-2. For this reason, blocking was hardly generated in the shelf stability test. However, the number of sheets wherein fog was generated was smaller than in Examples II-1 and II-2 in both of the ordinary printing durability test and the printing durability test after high-temperature standing. In Comparative Example II-2 also, it was observed that the number of printed sheets wherein fog was generated in the printing durability test after high-temperature standing tended to be smaller than the result of the ordinary printing durability test; however, the tendency was smaller than in Comparative Example II-1.

In Comparative Example II-3, wherein the wax TI-C, which was a wax obtained by purifying the ester wax used in above-mentioned Comparative Example II-2, was used, the minimum fixing temperature was not varied, and blocking was hardly generated (1%) in the shelf stability test. Since the wax was a purified wax, the number of printed sheets wherein fog was generated was larger in both of the ordinary printing durability test and the printing durability test after high-temperature standing than in Comparative Example II-2. However, the result was poor than the results of Examples II-1 and II-2. In particular, even in Comparative Example II-3, it was observed that the number of printed sheets wherein fog was generated tended to become smaller in the printing durability test after high-temperature standing than the result in the ordinary printing durability test. From this viewpoint, Examples II-1 and II-2 were quite excellent in the printing durability after high-temperature standing.

Example Series III

Test methods made in the present examples are as follows:

(1) Measurement of Thermal Characteristics of a Parting Agent According to Differential Scanning Calorimetry (DSC)

Thermal characteristics of a parting agent, such as the melting point thereof, were measured in the same way as in Example Series I. In this way, the top of a peak in the DSC curve was specified as the melting point (TmD).

(2) Penetration

The penetration of a parting agent was measured in the same way as in Example Series II.

(3) Molecular weight of a parting agent

The molecular weight of a parting agent was obtained in the same way as in Example Series II.

(4) Particle Diameter of a Toner

The volume average particle diameter Dv, and the particle size distribution Dv/Dp were measured with a particle diameter measuring device (trade name: MULTISIZER II, manufactured by Beckman Coulter Co.). This measurement with the MULTISIZER was made under the following conditions: aperture diameter=100 μm, medium=ISOTON II, concentration=10%, and the number of measured particles=100,000.

Specifically, 0.2 g of a toner sample was collected into a beaker, and thereto was added a solution of alkylbenzenesulfonic acid in water (trade name: DRYWELL, manufactured by Fuji Photo Film Co., Ltd.) as a dispersing agent. Thereto was further added 2 mL of ISOTON II to get the toner wet. Thereafter, thereto was added 10 mL of ISOTON II, and the toner was dispersed for 1 minute with an ultrasonic disperser. The resultant was then subjected to measurement with the above-mentioned particle diameter measuring device.

(5) Volume Resistivity of a Toner

Measurement was made in the same way as in Example Series I so as to obtain the volume resistivity.

(6) Minimum Fixing Temperature of a Toner (Low-Temperature Fixability)

Measurement was made in the same way as in Example Series I so as to evaluate the low-temperature fixability.

(7) Shelf Stability of a Toner

Measurement was made in the same way as in Example Series I.

(8) Printing Durability

A commercially available printer (printing speed: 24 A4-size sheets per minute) in a nonmagnetic one-component developing manner was used, and a toner was put into its development device. The printer was allowed to stand still in a normal-temperature and normal-humidity (N/N) environment having a temperature of 23° C. and a relative humidity of 50% for 24 hours. Thereafter, in the same environment, continuous printing was made at an image density of 1% up to 17,000 sheets. At intervals of 1,000 sheets, plain pattern printing was made (image density; 100%) and a reflection type image density measuring device (trade name: RD914, manufactured by Macbeth Co.) was used to measure the image density of the plain pattern printed region. Thereafter, white plain pattern printing (image density: 0%) was further made. In the middle of the white pattern printing, the printer was stopped, and then the toner in the non-image region on the photosensitive member subjected to development treatment was caused to adhere onto an adhesive tape (Scotch Mending Tape 810-3-18, manufactured by Sumitomo 3M Ltd.). The tape was peeled off, and caused to adhere onto a printing sheet. Next, the whiteness B (%) of the printing sheet onto which the adhesive tape was caused to adhere was measured with a whiteness colorimeter (manufactured by Nippon Denshoku Industries Co., Ltd.). In the same way, only an unused adhesive tape was caused to adhere onto a printing sheet, and the whiteness A (%) thereof was measured. The difference between the whitenesses (B-A) was defined as the fog value (%). As this value is smaller, fog is less generated so that a better image is obtained.

Examined was the number of continuously printed sheets wherein such an image quality that the image density was 1.3 or more and the fog value was 5% or less was able to be kept.

Production Example III-1

Wax III-A

A higher α-olefin polymer was yielded in the same way as the wax I-A in Production Example I-1. This was used as a wax III-A.

Production Example III-2

Wax III-B

A higher α-olefin polymer was yielded in the same way as the wax I-B in Production Example I-1. This was used as a wax III-B, Example III-1

A nonmagnetic one-component toner for developing electrostatic image was prepared in the same way as in Example I-1. Test results thereof are shown in Table III-1.

Example III-2

A toner for developing electrostatic image was prepared in the same way as in Example III-1 except that in Example II-1, the wax III-B yielded in Production Example III-2 was used instead of the was III-A. Test results thereof are shown in Table III-1.

Comparative Example III-1

A toner for developing electrostatic image was prepared in the same way as in Example III-1 except that in Example III-1, a commercially available wax III-C (trade name: PW130, manufactured by Nippon Seiro Co., Ltd.) was used instead of the wax III-A and the processing from the dissolution of the wax to the rise in the temperature in the polymerization was carried out in the state that the dispersion liquid wherein the polymerizable monomer composition or the droplets thereof were dispersed was kept at 50° C. while heated. Test results thereof are shown in Table III-1.

Comparative Example III-2

A toner for developing electrostatic image was prepared in the same way as in Example III-1 except that in Example III-1, a commercially available wax III-D (trade name: WEP- 4, manufactured by NOF Corporation.) was used instead of the wax III-A and the processing from the dissolution of the wax to the rise in the temperature in the polymerization was carried out in the state that the dispersion liquid wherein the polymerizable monomer composition or the droplets thereof were dispersed was kept at 40° C. while heated. Test results thereof are shown in Table III-1.

Table III-1 described below shows physical properties of the waxes III-A and III-B yielded in the above-mentioned Production Examples and used in the Examples of the invention, and the commercially available waxes III-C and III-D used in the Comparative Examples.

TABLE 5

Table III-1

| | Example III-1 | Example III-2 | Comparative Example III-1 | Comparative Example III-2 |
|---|---|---|---|---|
| Wax species | Wax III-A (α-olefin polymer) | Wax III-B (α-olefin polymer) | Wax III-C (paraffin wax) | Wax III-D (ester wax) |
| | (Parting agent) | | | |
| Melting point (TmD) (° C.) | 52 | 62 | 56 | 73 |
| Penetration (25° C.) | 1.4 | 2.1 | 13.1 | 5.2 |
| Number-average molecular weight (Mn) | 28,000 | 27,000 | 1,300 | 4,000 |
| Weight-average molecular weight (Mw) | 47,000 | 43,000 | 1,400 | 4,300 |
| Peak top molecular weight (Mp) | 46,000 | 38,000 | 1,300 | 3,900 |
| Molecular weight distribution (Mw/Mn) | 1.7 | 1.6 | 1.0 | 1.1 |
| | (Colored resin particles) | | | |
| Volume average particle diameter (Dv) (μm) | 7.6 | 7.9 | 7.7 | 7.4 |
| Particle size distribution (Dv/Dp) | 1.15 | 1.14 | 1.21 | 1.16 |
| Volume resistivity (log(Ω · cm)) | 11.3 | 11.4 | 11.0 | 11.4 |
| | (Toner) | | | |
| Minimum fixing temperature (° C.) | 145 | 150 | 150 | 165 |
| Shelf stability (wt %) | 1 or less | 1 or less | 100 | 1 or less |
| Printing durability (number of sheets) | 17,000 | 17,000 | 10,000 | 12,000 |

(Summary of the Results)

From the test results described in Table III-1, the following are understood:

About the toner of Comparative Example III-1, which contained the wax III-C, which was a paraffin wax having a larger penetration than the range specified in the invention, the minimum fixing temperature was equivalent to that in the Examples; thus, the low-temperature fixability was good. However, blocking of the toner was caused according to the shelf stability test, and the number of printed sheets according to the durability test was as small as 10,000. The shelf stability and the printing durability were poor.

About the toner of Comparative Example III-2, which contained the wax III-D, which was an ester wax having a higher melting point and a larger penetration than the ranges specified in the invention, the shelf stability was good, but the minimum fixing temperature was high and the number of printed sheets according to the durability test was as small as 12,000. Thus, the low-temperature fixability and the printing durability were poor.

On the other hand, the toners of the Examples, which each contained the aliphatic hydrocarbon polymer having a melting point and a penetration in the specific ranges defined in the invention, were good in all of shelf stability, low-temperature fixability and printing durability.

Example Series IV

Test methods made in the present examples are as follows:

(1) Measurement of Thermal Characteristics of a Parting Agent According to Differential Scanning Calorimetry (DSC)

Thermal characteristics of a parting agent, such as the melting point thereof, were measured in the same way as in Example Series I to yield a DSC curve thereof. In this way, the top of a peak in the DSC curve was specified as the melting point (TmD).

(2) Peak Top Molecular Weight of a Parting Agent

The peak top molecular weight of a parting agent was obtained in the same way as in Example Series II.

(3) Particle Diameter of a Toner

The particle diameter was measured in the same way as in Example Series III.

(4) Shelf Stability of a Toner

The shelf stability was measured in the same way as in Example Series I.

(5) Volume Resistivity of a Toner

The volume resistivity was obtained in the same way as in Example Series I.

(6) Minimum Fixing Temperature of a Toner (Low-Temperature Fixability)

A printer remodeled to be capable of varying the temperature of a fixing roller section in a commercially available printer (printing speed: 28 A4-size sheets per minute) in a nonmagnetic one-component developing manner was used to make a fixing test. In the fixing test, black plain pattern images (image density: 100%) were printed while the temperature of the fixing roller in the remodeled printer was varied. The fixing rate of the toner was measured at individual temperatures to obtain a relationship between the temperature and the fixing rate.

The fixing rate was obtained by peeling a tape in the black plain pattern printed region (image density: 100%) and calculating the rate between the image densities before and after the peeling of the tape. Specifically, when the image density before the tape was peeled is represented by ID (before) and the image density after the tape was peeled is represented by ID (after), the fixing rate can be calculated in accordance with the following equation;

$$\text{fixing rate (\%)}=(ID(\text{after})/ID(\text{before}))\times 100$$

The peeling of the tape is composed of a series of operations of causing the tape, which was an adhesive tape (trade name: Scotch Mending Tape 810-3-18, manufactured by Sumitomor 3M Ltd.), to adhere onto a region to be measured of the test sheet, pressing the tape at a predetermined pressure to stick the tape on the sheet, and then peeling the adhesive tape at a constant speed along the direction parallel to the sheet. The image density was measured by use of a reflection type image density measuring device (trade name: RD914, manufactured by Macbeth Co.).

In this fixing test, the lowest fixing roller temperature at which the fixing rate was over 80% was evaluated as the lowest fixing rate.

(7) Offset Resistance of a Toner

A printer remodeled to be capable of varying the temperature of a fixing roller section in a commercially available printer (printing speed: 14 A4-size sheets per minute) in a nonmagnetic one-component developing manner was used. In the offset resistance test, a printing pattern was printed which had a black plain pattern region (image density; 100%) and a white plain pattern region (image density: 0%) while the temperature of the fixing roller in this remodeled printer was varied from 150 to 220° C. at intervals of 10° C. At the individual temperatures, the white plain pattern region on the sheet was observed to check whether or not offset was generated with the naked eye. A case where the temperature at which high-temperature offset was generated was lower than 200° C. was evaluated as a bad toner (x), a case where the temperature was from 200 to 220° C. was evaluated as an acceptable toner (Δ), and a case where the temperature was 220° C. or higher was evaluated as a good toner (o).

(8) Printing Durability

The printing durability was measured in the same way as in Example Series III.

Production Example IV-1

Wax IV-A

Catalyst Production Example

Production of (1,2'-dimethylsilylene)(2,1'-dimethylsilylene)bis(3-trimethylsilylmethylindenyl)zirconium dichloride In a flow of nitrogen gas, into a 200-mL Schlenk bottle were charged 2.5 g (7.2 mmol) of (1,2'-dimethylsilylene)(2,1'-dimethylsilylene)bis(indene) and 100 mL of ether, and then the system was cooled to −78° C. Thereto was added 9.0 mL (14.8 mmol) of a n-butyllithium (n-BuLi) solution (concentration: 6 mol/L) in hexane. The temperature of the system was again returned to room temperature, and the solution was stirred for 12 hours.

The solvent was distilled off from the resultant solution, and the remaining solid was washed with 20 mL of hexane. Thereafter, the solid was dried under reduced pressure to yield a lithium salt of (1,2'-dimethylsilylene)(2,1'-dimethylsilylene)bis(indene) quantitatively as a white solid.

Next, in the Schlenk bottle, the resultant lithium salt (6.97 nmol) of (1,2'-dimethylsilylene)(2,1'-dimethylsilylene)bis(indene) was dissolved into 50 mL of tetrahydrofuran (THF), and at room temperature thereto was dropwise and slowly added 2.1 mL (14.2 mmol) of iodomethyltrimethylsilane. The solution was stirred for 12 hours.

After the stirring, the solvent was distilled off, and 50 mL of ether was added to the solution. Furthermore, thereto was added a saturated solution of ammonium chloride in water so as to perform washing. The aqueous phase was separated away, and the organic phase was dried to remove the solvent, thereby yielding 3.04 g (5.9 mmol) of (1,2'-dimethylsilylene)(2,1'-dimethylsilylene)bis(3-trimethylsilylmethylindene) (yield: 84%).

In a flow of nitrogen gas, into a Schlenk bottle was charged 3.04 g (5.9 mmol) of (1,2'-dimethylsilylene)(2,1'-dimethylsilylene)bis(3-trimethylsilylmethylindene) and 50 mL of ether, and then the system was cooled to −78° C. Thereto was added 7.4 mL (11.8 mmol) of a n-butyllithium (n-BuLi) solution (concentration: 1.6 mol/L) in hexane. Thereafter, the temperature of the system was returned to room temperature, and the solution was stirred for 12 hours.

After the stirring, the solvent was distilled off from the solution, and the remaining solid was washed with 40 mL of hexane to yield 3.06 g of an ether adduct of the lithium salt.

A 1H-NMR of this ether adduct of the lithium salt was measured. The following results were obtained.

1H-NMR (90 MHz, THF-d8): δ 0.04 (s, —SiMe3, 18H), 0.48 (s, —Me2Si—, 12H), 1.10 (t, —CH3, 6H), 2.59 (s, —CH2-, 4H), 3.38 (q, —CH2-, 4H), 6.2-7.7 (m, Ar—H, 8H)

In a flow of nitrogen gas, 3.06 g of the ether adduct of the lithium salt, which was obtained as described, was suspended into 50 mL of toluene, and the system was cooled to −78° C. Thereto was dropwise added a liquid suspension of 1.2 g (5.1 mmol) of zirconium tetrachloride in toluene (20 mL), which was beforehand cooled to −78° C., and then the temperature of the system was returned to room temperature. The suspension was then stirred for 6 hours.

The solvent in the resultant solution was distilled off, and the remaining solid was recrystallized from dichloromethane to yield 0.9 g (1.33 mmol) of a yellow microcrystal of (1,2'-dimethylsilylene)(2,1'-dimethylsilylene)bis(3-trimethylsilylmethylindenyl)zirconium dichloride (yield: 26%).

A 1H-NMR of this yellow microcrystal was measured. The following results were obtained.

1H-NMR (90 MHz, CDCl3): δ0.0 (s, —SiMe3-, 18H), 1.02-1.12 (s, —Me3Si—, 12H), 2.51 (dd, —CH2-, 4H), 7.1-7.6 (m, Ar—H, 8H)

(Preparation of a Monomer)

α-Olefin (trade name: "LINEAREN 2024", manufactured by Idemitsu Kosan Co., Ltd.) was distilled under a reduced pressure (of 2 to 14 mmHg) at a distillation temperature of 140 to 230° C. to yield α-olefin fractions having the following composition: C22: 63.5%, and C24: 36.5%. The resultant α-olefin fractions were introduced into a heated and dried 5-L Schlenk bottle, and then subjected to dehydrating treatment with dry nitrogen and activated alumina for 8 hours.

(α-olefin Polymerization)

Into a heated and dried 10-L autoclave were charged 5 L of the dehydrated α-olefin fractions, and then the temperature of the system was raised to a polymerization temperature of 75° C. Thereafter, thereto were added 12 mmol of triisobutylaluminum, 25 μmol (toluene slurry (20 μmol/mL, 1.25 mL)) of (1,2'-dimethylsilylene)(2,1'-dimethylsilylene)bis(3-trimethylsilylmethylindenyl)zirconium dichloride, yielded in Catalyst Production Example described above, and 100 μmol (toluene slurry (20 μmol/mL, 5 mL)) of dimethylanilinium tetrakispentafluorophenylborate, and then hydrogen was introduced into the system to give a pressure of 0.05 MPa. The polymerization temperature was kept for 4 hours to conduct polymerization reaction.

After the end of the polymerization reaction, the resultant reactant was precipitated with acetone, and then the system was heated and the pressure therein was reduced to distill off the solvent and dry the precipitation to yield 1.7 kg of an α-olefin copolymer. This was used as a wax IV-A.

Example IV-1

A media type wet pulverizer was used to wet-pulverize 78 parts of styrene and 22 parts of n-butyl acrylate (the Tg of a copolymer obtained by copolymerizing these monomers was 50° C.) as monovinyl monomers, 0.3 part of a polymethacrylic acid ester macromonomer (trade name: AA6, manufactured by Toagosei Co., Ltd.; Tg=94° C.) as a macromonomer, 0.7 part of divinylbenzene as a crosslinkable monomer, 1.85 parts of t-dodecylmercaptane as a molecular weight modifier, and 7 parts of carbon black (trade name; #25B, manufactured by Mitsubishi Chemical Corp.) as a black colorant. The following were added to the mixture obtained by the wet pulverization: 1 part of a charge control resin (trade name: ACRYBASE FCA-207P, manufactured by Fujikura Kasei Co., Ltd.) as a charge control agent; and 8 parts of the wax IV-A (the aliphatic hydrocarbon polymer yielded in Production Example I-1) and 2 parts of a wax IV-B (trade name: WEP6, manufactured by NOF Corporation.) as parting agents. The components were then mixed, and the predetermined components were dissolved to prepare a polymerizable monomer composition.

Separately, an aqueous solution wherein 4.8 parts of sodium hydroxide were dissolved in 50 parts of ion-exchanged water was gradually added to an aqueous solution wherein 8.6 parts of magnesium chloride were dissolved in 170 parts of ion-exchanged water while the solution was stirred, so as to prepare a colloid dispersion liquid of magnesium hydroxide.

The polymerizable monomer composition was added to the colloid dispersion liquid of magnesium hydroxide (magnesium hydroxide colloid amount: 3.5 parts) obtained as described above, and further the resultant was stirred. Thereto were added 6 parts of t-butyl peroxy-isobutylate (trade name: PERBUTYL IB, manufactured by NOF Corporation.) as a polymerization initiator.

The dispersion liquid to which the polymerization initiator was added was subjected to dispersion with an in-line type emulsification dispersing machine (trade name: EBARA MILDER MDN303V, manufactured by Ebara Corp.) at a rotation number of 15,000 rpm, so as to form droplets of the polymerizable monomer composition.

The dispersion liquid wherein the droplets were formed was put into a reactor, and the temperature thereof was raised to 95° C. to conduct polymerization reaction. After the polymerization conversion rate reached to substantially 100%, to the reaction was added 1 part of methyl methacrylate (Tg of the polymer to be yielded =105° C.), which was a polymerizable monomer for shell. Subsequently, into 10 parts of water was dissolved 0.1 part of 2,2'-azobis(2-methyl-N-(2-hydroxyethyl)-propionamide) (trade name: VA-086, manufactured by Wako Pure Chemical Industries, Ltd.; water-soluble) as a polymerization initiator for shell, and the resultant was added to the reactor. Furthermore, the system was kept at 95° C. for 4 hors to continue the polymerization. Thereafter, the reactor was cooled with water to stop the reaction, thereby yielding an aqueous dispersion liquid of core-shell structured colored resin particles.

While the resultant aqueous dispersion liquid of the colored resin particles was stirred, washing with acid on the basis of addition of sulfuric acid was performed (at 25° C. for 10 minutes) until the pH turned to 4.5 or less. Thereafter, the resultant was filtrated, dehydrated, and further dried to yield dried colored resin particles.

To 100 parts of the dried colored resin particles were added 1 part of silica fine particles (number-average primary particle diameter: 7 nm) subjected to hydrophobicity-imparting treatment with cyclic silazane, and 1 part of silica fine particles (number-average primary particle diameter: 35 nm) subjected to hydrophobicity-imparting treatment with amino-modified silicone oil. The components were mixed by use of a high-speed mixer (trade name: HENSCHEL MIXER, manufactured by Mitsui Mining Co., Ltd.), so as to prepare a nonmagnetic one-component toner for developing electrostatic image. The test results are shown in Table IV-2.

Example IV-2

A toner for developing electrostatic image was prepared in the same way as in Example IV-1 except that in Example IV-1, 6 parts of the wax IV-A and 4 parts of a wax IV-C (trade name: WEP7, manufactured by NOF Corporation.) were used instead of the 8 parts of the wax IV-A and the 2 parts of the wax IV-B as the parting agents. Test results thereof are shown in Table IV-2.

Example IV-3

A toner for developing electrostatic image was prepared in the same way as in Example IV-2 except that about the addition amounts of the individual waxes as the parting agents in Example IV-2, the amount of the wax IV-A was changed to 18 parts and that of the wax IV-C was changed to 2 parts. Test results thereof are shown in Table IV-2.

Comparative Example IV-1

A toner for developing electrostatic image was prepared in the same way as in Example IV-1 except that about the parting agents in Example IV-1, the wax IV-B was not used and 10 parts of only the wax IV-A were used. Test results thereof are shown in Table IV-2.

Comparative Example IV-2

A toner for developing electrostatic image was prepared in the same way as in Example IV-1 except that about the parting agents in Example IV-1, the wax IV-A was not used and 10 parts of only the wax IV-B were used. Test results thereof are shown in Table IV-2.

Comparative Example IV-3

A toner for developing electrostatic image was prepared in the same way as in Example IV-1 except that in Example IV-1, 8 parts of the wax IV-B and 2 parts of a wax IV-D (trade name: PW130, manufactured by Nippon Seiro Co., Ltd.) were used instead of the 8 parts of the wax IV-A and the 2 parts of the wax TV-B as the parting agents and the processing from the dissolution of the parting agents to the rise in the temperature in the polymerization was carried out in the state that the dispersion liquid wherein the polymerizable monomer composition or the droplets thereof were dispersed was kept at 50° C. while heated. Test results thereof are shown in Table IV-2.

Comparative Example IV-4

A toner for developing electrostatic image was prepared in the same way as in Example IV-1 except that in Example IV-1, 8 parts of the wax IV-C and 2 parts of a wax IV-E (trade name: FT100, manufactured by Nippon Seiro Co., Ltd.) were used instead of the 8 parts of the wax IV-A and the 2 parts of the wax IV-B as the parting agents, so as to carry out the processing. The wax IV-E was in a state that no monomer was dissolved in the wax and the wax was finely pulverized and dispersed through the step of the wet pulverization using the media type wet pulverizer. Test results thereof are shown in Table IV-2.

Table IV-1 described below shows physical properties of the wax TV-A yielded in the above-mentioned Production Examples and the commercially available waxes IV-B, IV-C and IV-E, the waxes being used in the Examples of the invention or the Comparative Examples.

TABLE 6

Table IV-1

| | Wax IV-A | Wax IV-B | Wax IV-C | Wax IV-D | Wax IV-E |
|---|---|---|---|---|---|
| Wax species | α-Olefin polymer | Ester wax (WEP6) | Ester wax (WEP7) | Paraffin wax (PW130) | Fisher-Tropsch wax (FT100) |
| | | (DSC measurement) | | | |
| Melting point (TmD) (° C.) | 60 | 76 | 73 | 56 | 98 |
| | | (GPC measurement) | | | |
| Peak top molecular weight (Mp) | 38,000 | 2,500 | 3,900 | 1,300 | 2,400 |

Results of the Examples of the invention and the Comparative Examples are shown in Table IV-2.

TABLE 7

Table IV-2

| | Example IV-1 | Example IV-2 | Example IV-3 | Comparative Example IV-1 | Comparative Example IV-2 | Comparative Example IV-3 | Comparative Example IV-4 |
|---|---|---|---|---|---|---|---|
| Addition amount (wt %) of used parting agent | Wax IV-A (8 parts) Wax IV-B (2 parts) | Wax IV-A (6 parts) Wax IV-C (4 parts) | Wax IV-A (18 parts) Wax IV-C (2 parts) | Wax IV-A (10 parts) | Wax IV-B (10 parts) | Wax IV-B (8 parts) Wax IV-D (2 parts) | Wax IV-C (8 parts) Wax IV-E (2 parts) |
| | | | (Toner characteristics) | | | | |
| Volume average particle diameter Dv(μm) | 9.1 | 9.0 | 9.2 | 9.1 | 9.3 | 9.5 | 9.5 |
| Particle size distribution (Dv/Dp) | 1.11 | 1.12 | 1.11 | 1.09 | 1.16 | 1.19 | 1.21 |
| Volume resistivity (log(Ω · cm)) | 11.4 | 11.3 | 11.4 | 11.4 | 11.3 | 11.1 | 11.3 |
| Shelf stability(wt %) | 1 or less | 1 or less | 1 or less | 1 or less | 1 or less | 100 | 1 or less |
| Minimum fixing temperature (° C.) | 160 | 160 | 155 | 165 | 180 | 170 | 180 |
| Offset resistance | ○ | ○ | ○ | Δ | ○ | ○ | ○ |
| Printing durability (number of sheets) | 17,000 | 17,000 | 17,000 | 17,000 | 15,000 | 10,000 | 15,000 |

(Summary of the Results)

From the test results described in Table IV-2, the following are understood:

About the toner of Comparative Example IV-1, wherein only the wax A was used, the shelf stability and the low-temperature fixability were excellent; however, the offset resistance was poor.

About the toner of Comparative Example IV-2, wherein only the wax IV-B was used, the minimum fixing temperature was higher than that of the toner of Comparative Example IV-1, and the printing durability also tended to deteriorate to some degree. Thus, both of the low-temperature fixability and the printing durability were insufficient.

About the toner of Comparative Example IV-3, wherein the wax IV-B and the wax IV-D, which was a paraffin wax, were used together, the shelf stability, the low-temperature fixability and the printing durability were each insufficient.

About the toner of Comparative Example IV-4, wherein the wax IV-C and the wax IV-E, which was Fisher-Tropsh wax, were used together, the minimum fixing temperature was higher than that of the toner of Comparative Example IV-1, and the printing durability also tended to deteriorate to some degree. Thus, both of the low-temperature fixability and the printing durability were insufficient.

On the other hand, about the toners of the Examples, wherein the specific aliphatic hydrocarbon polymer defined in the invention and the low molecular weight wax were used, the offset resistance was excellent, and the shelf stability, the low-temperature fixability and the printing durability were each good.

Industrial Applicability

The toner for developing electrostatic image obtained according to the invention may be used as a developer in an electrophotographic image-forming device, such as a facsimile machine, a copying machine, or a printer.

The invention claimed is:

1. A toner for developing electrostatic image, comprising colored resin particles containing a binder resin, a colorant, a first parting agent and a second parting agent, wherein the first parting agent and the second parting agent are characterized by the following:

(1) the first agent is an aliphatic hydrocarbon polymer being obtained by polymerizing an aliphatic hydrocarbon monomer and having a peak top molecular weight of 10,000 or more and a melting point of 70° C. or lower, wherein the aliphatic hydrocarbon polymer is a higher α-olefin polymer obtained by polymerizing an a-olefin monomer having 16 or more carbon atoms; and (2) the second agent is a low molecular weight wax having a peak top molecular weight of 5,000 or less.

2. The toner for developing electrostatic image according to claim 1, wherein the aliphatic hydrocarbon polymer is characterized by the following:

(1) the aliphatic hydrocarbon polymer has a single melting point (TmD) defined as the temperature of the top of a peak in the DSC curve of the aliphatic hydrocarbon polymer according to a Differential Scanning Calorimetry (DSC); and (2) the half value width of the peak is 12° C. or less.

3. The toner for developing electrostatic image according to claim 1, wherein the aliphatic hydrocarbon polymer is characterized by the following:

(1) the penetration (JIS K2235-1991) at 25° C. of the aliphatic hydrocarbon polymer is 3 or less; and (2) the solubility thereof in toluene at 25° C. is in the range from 5 to 60% by weight.

4. The toner for developing electrostatic image according to claim 1, wherein the melting point (TmD) of the aliphatic hydrocarbon polymer is 40° C. or higher and 70° C. or lower.

5. The toner for developing electrostatic image according to claim 1, wherein the aliphatic hydrocarbon polymer is characterized by the following:

(1) the melting point (TmD) of the aliphatic hydrocarbon polymer is 70° C. or lower; and (2) the penetration (JIS K2235-1991) at 25° C. of the aliphatic hydrocarbon polymer is 3 or less.

6. The toner for developing electrostatic image according to claim 5, wherein the weight-average molecular weight of the aliphatic hydrocarbon polymer is 10,000 or more and 100,000 or less.

7. The toner for developing electrostatic image according to claim 1, wherein the higher α-olefin polymer is a polymer obtained by polymerization in the presence of a metallocene compound as a catalyst.

8. The toner for developing electrostatic image according to claim 1, wherein the low molecular weight wax is an ester wax.

9. The toner for developing electrostatic image according to claim 1, wherein the melting point (TmD) of the aliphatic hydrocarbon polymer is equal to or lower than the melting point (TmD) of the low molecular weight wax.

10. The toner for developing electrostatic image according to claim 1, wherein the ratio by content of the aliphatic hydrocarbon polymer to the low molecular weight wax (the content of the aliphatic hydrocarbon polymer/the content of the low molecular weight wax) is in the range from 98/2 to 25/75.

11. The toner for developing electrostatic image according to claim 1, wherein the colored resin particles are produced by a wet method.

12. The toner for developing electrostatic image according to claim 1, wherein the colored resin particles are core-shell structured colored resin particles.

* * * * *